US007142185B2

(12) United States Patent
Aoki

(10) Patent No.: US 7,142,185 B2
(45) Date of Patent: Nov. 28, 2006

(54) LIQUID CRYSTAL DISPLAY, IMAGE DATA COMPENSATION CIRCUIT, IMAGE DATA COMPENSATION METHOD, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 475 days.

(21) Appl. No.: 09/994,674

(22) Filed: Nov. 28, 2001

(65) Prior Publication Data

US 2002/0067326 A1 Jun. 6, 2002

(30) Foreign Application Priority Data

Dec. 1, 2000 (JP) ..... 2000-366965
Oct. 30, 2001 (JP) ..... 2001-332921

(51) Int. Cl.
*G09G 3/36* (2006.01)

(52) U.S. Cl. ..... 345/89; 345/50; 345/55; 345/84; 345/87; 345/90; 345/92; 345/650

(58) Field of Classification Search ..... 345/89, 345/87, 84, 90, 92, 50, 55, 690, 96, 98–99, 345/101
See application file for complete search history.

(56) References Cited

U.S. PATENT DOCUMENTS 4,663,662 A * 5/1987 Sekizawa et al. ..... 358/530
5,191,455 A * 3/1993 Hashimoto et al. ..... 345/96
6,115,084 A * 9/2000 Miyashita et al. ..... 348/792
6,177,914 B1 * 1/2001 Iwama et al. ..... 345/60
6,229,515 B1 * 5/2001 Itoh et al. ..... 345/103
6,392,630 B1 * 5/2002 Lin et al. ..... 345/98
6,429,841 B1 * 8/2002 Lee ..... 345/89

FOREIGN PATENT DOCUMENTS

| | | |
|---|---|---|
| JP | A-62-131233 | 6/1987 |
| JP | 2-184891 | 7/1990 |
| JP | A-05-064110 | 3/1993 |
| JP | 9-146496 | 6/1997 |
| JP | 11-109927 | 4/1999 |
| JP | 11-113019 | * 4/1999 |
| JP | 2000-284773 | 10/2000 |

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

An interpolation processor interpolates reference compensation data stored in a ROM according to the level, generates compensation data corresponding to levels available to image data for each pair of reference coordinates, and stores the compensation data in a compensation table. An address generator specifies storage regions for compensation data corresponding to four pairs of reference coordinates positioned near coordinates of the image data among the compensation data stored in the compensation table. An arithmetic unit interpolates the compensation data read from the compensation table according to the coordinates and generates compensation data. In writing positive polarity, the compensation data is added to the image data. In writing negative polarity, compensation is not performed. It is thereby possible to reduce, minimize or prevent flickering generated in the entire region of a display screen.

26 Claims, 22 Drawing Sheets

FIG. 9

12

| (X,Y) | R:Drefr | | | G:Drefg | | | B:Drefb | | |
|---|---|---|---|---|---|---|---|---|---|
| (1,1) | DRw1,1 | DRc1,1 | DRb1,1 | DGw1,1 | DGc1,1 | DGb1,1 | DBw1,1 | DBc1,1 | DBb1,1 |
| (128,1) | DRw128,1 | DRc128,1 | DRb128,1 | DGw128,1 | DGc128,1 | DGb128,1 | DBw128,1 | DBc128,1 | DBb128,1 |
| (256,1) | DRw256,1 | DRc256,1 | DRb256,1 | DGw256,1 | DGc256,1 | DGb256,1 | DBw256,1 | DBc256,1 | DBb256,1 |
| ⋮ | ⋮ | ⋮ | ⋮ | ⋮ | ⋮ | ⋮ | ⋮ | ⋮ | ⋮ |
| (i,j) | DRwi,j | DRci,j | DRbi,j | DGwi,j | DGci,j | DGbi,j | DBwi,j | DBci,j | DBbi,j |
| ⋮ | ⋮ | ⋮ | ⋮ | ⋮ | ⋮ | ⋮ | ⋮ | ⋮ | ⋮ |
| (1024,768) | DRw1024,768 | DRc1024,768 | DRb1024,768 | DGw1024,768 | DGc1024,768 | DGb1024,768 | DBw1024,768 | DBc1024,768 | DBb1024,768 |

63 POINTS

FIG. 11

14R

| | (X,Y) | FIRST COLUMN m | SECOND COLUMN m+1 | THIRD COLUMN m+2 | ... | (N-1)TH COLUMN n-1 | NTH COLUMN n |
|---|---|---|---|---|---|---|---|
| FIRST ROW | (1,1) | DHr1, 1(m) | DHr1, 1(m+1) | DHr1, 1(m+2) | ... | DHr1, 1(n-1) | DHr1, 1(n) |
| SECOND ROW | (128,1) | DHr128, 1(m) | DHr128, 1(m+1) | DHr128, 1(m+2) | ... | DHr128, 1(n-1) | DHr128, 1(n) |
| ... | ... | ... | ... | ... | ... | ... | ... |
| TENTH ROW | (1,128) | DHr1, 128(m) | DHr1, 128(m+1) | DHr1, 128(m+2) | ... | DHr1, 128(n-1) | DHr1, 128(n) |
| ELEVENTH ROW | (128,128) | DHr128, 128(m) | DHr128, 128(m+1) | DHr128, 128(m+2) | ... | DHr128, 128(n-1) | DHr128, 128(n) |
| ... | ... | ... | ... | ... | ... | ... | ... |
| SIXTY-THIRD ROW | (1024,768) | DHr1024, 768(m) | DHr1024, 768(m+1) | DHr1024, 768(m+2) | ... | DHr1024, 768(n-1) | DHr1024, 768(n) |

FIG. 16

12'

63 POINTS

| (X,Y) | R:Drefr | | | G:Drefg | | | B:Drefb | | |
|---|---|---|---|---|---|---|---|---|---|
| (1,1) | DRw1,1 | DRc1,1 | DRb1,1 | DGw1,1 | DGc1,1 | DGb1,1 | DBw1,1 | DBc1,1 | DBb1,1 |
| (128,1) | - | - | - | DGw128,1 | DGc128,1 | DGb128,1 | - | - | - |
| (256,1) | DRw256,1 | DRc256,1 | DRb256,1 | DGw256,1 | DGc256,1 | DGb256,1 | DBw256,1 | DBc256,1 | DBb256,1 |
| ⋮ | ⋮ | ⋮ | ⋮ | ⋮ | ⋮ | ⋮ | ⋮ | ⋮ | ⋮ |
| (1,128) | - | - | - | DGw1,128 | DGc1,128 | DGb1,128 | - | - | - |
| (128,128) | - | - | - | DGw 128,128 | DGc 128,128 | DGb 128,128 | - | - | - |
| (256,128) | - | - | - | DGw 256,128 | DGc 256,128 | DGb 256,128 | - | - | - |
| ⋮ | ⋮ | ⋮ | ⋮ | ⋮ | ⋮ | ⋮ | ⋮ | ⋮ | ⋮ |
| (1024,128) | - | - | - | DGw 1024,128 | DGc 1024,128 | DGb 1024,128 | - | - | - |
| ⋮ | ⋮ | ⋮ | ⋮ | ⋮ | ⋮ | ⋮ | ⋮ | ⋮ | ⋮ |
| (1024,768) | DRw1024, 768 | DRc1024, 768 | DRb1024, 768 | DGw1024, 768 | DGc1024, 768 | DGb1024, 768 | DBw1024, 768 | DBc1024, 768 | DBb1024, 768 |

FIG. 17

14R'

| | (X,Y) | FIRST COLUMN m | SECOND COLUMN m+1 | THIRD COLUMN m+2 | ... | (N-1)TH COLUMN n-1 | NTH COLUMN n |
|---|---|---|---|---|---|---|---|
| FIRST ROW | (1,1) | DHr1, 1(m) | DHr1, 1(m+1) | DHr1, 1(m+2) | ... | DHr1, 1(n-1) | DHr1, 1(n) |
| SECOND ROW | (256,1) | DHr256, 1(m) | DHr256, 1(m+1) | DHr256, 1(m+2) | ... | DHr256, 1(n-1) | DHr256, 1(n) |
| ... | ... | ... | ... | ... | ... | ... | ... |
| FIFTH ROW | (1024,1) | DHr1024, 1(m) | DHr1024, (m+1) | DHr1024, (m+2) | ... | DHr1024, (n-1) | DHr1024, (n) |
| SIXTH ROW | (1,256) | DHr1, 256(m) | DHr1, 256(m+1) | DHr1, 256(m+2) | ... | DHr1, 256(n-1) | DHr1, 256(n) |
| ... | ... | ... | ... | ... | ... | ... | ... |
| TWENTIETH ROW | (1024,768) | DHr1024, 768(m) | DHr1024, 768(m+1) | DHr1024, 768(m+2) | ... | DHr1024, 768(n-1) | DHr1024, 768(n) |

LIQUID CRYSTAL DISPLAY, IMAGE DATA COMPENSATION CIRCUIT, IMAGE DATA COMPENSATION METHOD, AND ELECTRONIC APPARATUS

BACKGROUND OF THE INVENTION

1. Field of Invention

The present invention relates to a liquid crystal display, an image data compensation circuit, an image data compensation method, and an electronic apparatus, in which flickering or the like is appropriately reduced, minimized or prevented over the entire display region.

2. Description of Related Art

A conventional liquid crystal display, such as an active matrix liquid crystal display, is primarily formed of a liquid crystal panel, a processing circuit, and a timing control circuit. Among these components, the liquid crystal panel is formed of a pair of substrates with TN (Twisted Nematic) liquid crystals provided therebetween. Specifically, out of the pair of substrates, one substrate is provided with a plurality of scanning lines and a plurality of data lines. The scanning lines and the data lines intersect each other and are electrically insulated from each other. At each of these intersections, a pair of a thin film transistor (hereinafter referred to as a "TFT"), which is an example of a switching element, and a pixel electrode is provided.

The other substrate is provided with a transparent counter electrode (common electrode) opposed to the pixel electrodes, and the counter electrode is maintained at a predetermined potential. Opposing surfaces of the two substrates are provided with alignment layers, which are rubbed so that liquid crystal molecules are continuously twisted approximately 90 degrees in the major axis direction between the two substrates. Back surfaces of the two substrates are provided with polarizers in accordance with the alignment direction.

Concerning the TFTs which are provided at the intersections of the scanning lines and the data lines, when a scanning signal (gate signal) applied to the corresponding scanning line becomes the ON-state potential, a connection between the source connected to the data line and the drain connected to the pixel electrode is established. Thus, an image signal supplied to the data line is applied to the pixel electrode, and the potential difference between the potential of the counter electrode and the potential of the image signal is applied to a liquid crystal capacitor formed of the pixel electrode, the counter electrode, and the liquid crystal therebetween. If the switching is turned OFF, the liquid crystal capacitor maintains the applied potential difference in accordance with the characteristics of the liquid crystal capacitor and a storage capacitor.

If the effective value of a voltage (hereinafter referred to as the "effective voltage") applied to the liquid crystal capacitor is zero, light which passes through the liquid crystal capacitor is rotated by approximately 90 degrees along the twisting of the liquid crystal molecules. As the effective voltage increases, the liquid crystal molecules tilt toward the electrical field direction. As a result, the optical activity is lost. For example, in a transmissive liquid crystal display, when polarizers in which polarizing axes are orthogonal to each other in accordance with the alignment direction are formed at the light-incident side and the back side (in normally white mode), and when the effective voltage applied to the liquid crystal capacitor is zero, the transmissivity is maximized (thereby displaying white). As the effective voltage applied across the two electrodes increases, light is blocked, and eventually the transmissivity is minimized (thus displaying black).

By driving the scanning lines and the data lines with appropriate timing, the effective voltage in accordance with the gray level can be applied to each liquid crystal capacitor. As a result, gray-scale display in which the gray-level differs for each pixel can be performed.

In principle, a liquid crystal display employs an alternating current (AC) driving method for driving the liquid crystal capacitor in order to prevent deterioration of the liquid crystal, which is caused by application of a direct current (DC) component. An image signal applied to the pixel electrode via the data line is alternately inverted every predetermined period between the positive polarity and the negative polarity on the basis of a predetermined constant potential Vc.

SUMMARY OF THE INVENTION

In a switching element, such as a TFT, a phenomenon which is referred to as a push-down phenomenon occurs. Specifically, as shown in FIG. 13(*a*), the push-down phenomenon means that, when a scanning signal (gate signal) changes from an ON-state potential Vdd to an OFF-state potential Vss, the potential change reduces the potential of the drain (pixel electrode) via a parasitic capacitance between the gate and the drain.

The potential displacement caused by the push-down phenomenon increases as a write potential, namely, a source potential, decreases. When voltages Vgp and Vgn which correspond to the same gray level are written towards the positive polarity side and the negative polarity side, potential displacements PD and ND which are caused by the push-down phenomenon are such that the latter is larger than the former.

When light passes between the two substrates, part of the light enters the TFT. Even when the scanning signal becomes the OFF-state potential Vss, thereby entering the OFF period (holding period), a small leakage current (light current) flows through the TFT. Particularly in a projector that enlarges and projects an image using a liquid crystal panel, the liquid crystal panel is irradiated with extremely intense light. Compared with a direct-viewing-type liquid crystal panel, it is considered that the effect of light leakage cannot be ignored. Since the degree of light leakage is influenced by the potential of the data line, the degree of leakage may differ between positive polarity writing and negative polarity writing.

Accordingly, the effective voltage (which corresponds to portions indicated by oblique lines in FIG. 13(*a*)) applied to the liquid crystal capacitor may differ between positive polarity writing and negative polarity writing, and hence a DC component is applied to the liquid crystal capacitor, even though AC driving is performed. As a result, so-called burn-in occurs. Also, flickering occurs when a gray level corresponding to positive polarity writing and a gray level corresponding to negative polarity writing are alternately displayed. As a result, the display quality is significantly deteriorated.

The potential displacements caused by the push-down phenomenon and the degree of light leakage depend not only on positive polarity writing/negative polarity writing but also on the position of a pixel. This is because element characteristics are not even in the entire display region, and the light irradiation intensity is uneven in the plane. Thus, simply taking into consideration positive polarity writing/ negative polarity writing is insufficient to suppress deterioration of the display quality due to the push-down phenomenon and light leakage.

If the position of a pixel and positive polarity writing/negative polarity writing are taken into consideration to suppress deterioration of the display quality, the configuration may become complex and large. Such a configuration may contradict general demands for liquid crystal displays.

In view of the foregoing circumstances, it is an object of the present invention to provide a liquid crystal display, an image data compensation circuit, an image data compensation method, and an electronic apparatus, in which deterioration of the display quality due to so-called burn-in or flickering can be reduced, minimized or prevented in a simple manner.

In order to achieve the foregoing objects, an image data compensation method according to a first aspect of the invention converts image data, indicating the gray levels of pixels aligned in the form of a matrix in the X direction and the Y direction, into analog data and compensates the image data when a voltage signal is supplied to each of the pixels. The polarity of the voltage signal is inverted on the basis of a predetermined constant potential every predetermined period. The image data compensation method includes the steps of storing reference compensation data corresponding to specific levels among levels available to the image data for each pair of reference coordinates preset in a display region in which the pixels are aligned; interpolating the stored reference compensation data in the level directions to generate first compensation data corresponding to the levels available to the image data for each pair of reference coordinates and storing the first compensation data in association with each pair of reference coordinates and the levels; selectively reading, from the stored first compensation data, pieces of data which correspond to pairs of reference coordinates positioned near the coordinates of the pixel corresponding to the image data and which correspond to the level of the image data; interpolating the read first compensation data in the coordinate directions to generate second compensation data which corresponds to the image data; and adding the second compensation data to the image data at least in one of a case in which the voltage signal is positive and a case in which the voltage signal is negative with respect to the constant potential, whereby the image data is compensated.

According to this method, reference compensation data is interpolated in the level directions, thereby generating first compensation data. Subsequently, the first compensation data is interpolated in the coordinate directions, thereby generating second compensation data. The second compensation data is then added as compensation data to image data, which corresponds at least to one polarity. Specifically, the compensation data is generated while writing polarities, and a coordinate position corresponding to the image data are taken into consideration. Therefore, it is possible to suppress deterioration of the display quality due to burn-in or flickering for each of pixels that are aligned in the form of a matrix. Since only pieces of reference compensation data which correspond to each pair of reference coordinates in a display region, and which correspond to specific levels among levels available to the image data, are stored in advance, the capacity required in a memory is reduced, thereby simplifying the configuration.

In order to achieve the foregoing objects, an image data compensation circuit according to a second aspect of the invention converts image data, indicating the gray levels of pixels aligned in the form of a matrix in the X direction and the Y direction, into analog data and compensates the image data when a voltage signal is supplied to each of the pixels. The polarity of the voltage signal is inverted on the basis of a predetermined constant potential every predetermined period. The image data compensation circuit includes a memory that stores reference compensation data corresponding to specific levels among levels available to the image data for each pair of reference coordinates preset in a display region in which the pixels are aligned; an interpolation processor that interpolates the reference compensation data stored in the memory in the level directions to generate first compensation data corresponding to the levels available to the image data for each pair of reference coordinates; a compensation table that stores the first compensation data in association with the reference coordinates and the levels; a reading unit that reads, from the first compensation data stored in the compensation table, pieces of data which correspond to pairs of reference coordinates positioned near the coordinates of the pixel corresponding to the image data and which correspond to the level of the image data; an arithmetic unit that interpolates the read first compensation data in the coordinate direction to generate second compensation data corresponding to the image data; and an adder that adds the second compensation data to the image data at least in one of a case in which the voltage signal is positive and a case in which the voltage signal is negative with respect to the constant potential, whereby the image data is compensated. Arranged as described above, as in the first aspect of invention, compensation data is generated while writing polarities and a coordinate position corresponding to the image data are taken into consideration. Thus, it is possible to properly reduce, minimize or prevent deterioration of the display quality due to burn-in or flickering for each of pixels aligned in the form of a matrix and to reduce the capacity required in a memory, whereby the configuration can be simplified.

According to the present invention, it is unnecessary to output compensation data in association with both polarities, namely, positive polarity writing and negative polarity writing. It is only necessary to consequently make the effective voltage in one polarity equal to the effective voltage in the other polarity. According to the second aspect of the invention, preferably the adder adds the second compensation data to the image data only in one of the case in which the voltage signal is positive and the case in which the voltage signal is negative. In the other one of the case in which the voltage signal is positive and the case in which the voltage signal is negative, the adder preferably adds a substantially zero value to the image data. With the arrangement described above, it is only necessary to generate compensation data in association with either writing polarity. This enables the configuration to be simplified.

In a liquid crystal display, a slight difference in the effective value of a voltage applied to a liquid crystal capacitor in a region in which the gray level of a pixel is intermediate (gray) causes a great change in the gray level. Conversely, when an image signal which corresponds to gray is applied to a pixel electrode by alternately applying a positive image signal and a negative image signal in order that the gray levels may be approximately the same, the effective voltages in both polarities applied to the liquid crystal capacitor can be made to be equal. In order to make the effective voltage in one polarity equal to the effective voltage in the other polarity, the reference compensation data corresponding to the specific level is preferably a value that is adjusted so as to reduce the difference in the gray level between one case in which the sum of the reference compensation data and the image data corresponding to the specific level is applied to a pixel electrode and the other case in which the reference compensation data is not added to the image data corresponding to the specific level and the image data is applied to the pixel electrode. Accordingly, it is possible to set reference compensation data corresponding to specific levels without taking into account the degree of an actual push-down phenomenon and light leakage.

According to the second aspect of the invention, preferably the reading unit includes an X counter that counts first clock signals which are used as a time reference for X-direction scanning in the display region and for generating X-coordinate data indicating the X coordinate of the pixel corresponding to the image data in the display region; a Y counter that counts second clock signals which are used as a time reference for Y-direction scanning in the display region and for generating Y-coordinate data indicating the Y coordinate of the pixel corresponding to the image data in the display region; and an address generator that specifies a plurality of pairs of reference coordinates positioned near the coordinates of the pixel corresponding to the image data based on the X-coordinate data and the Y-coordinate data and that generates addresses for reading the corresponding first compensation data from the compensation table based on the specified pairs of reference coordinates and the level of the image data. Preferably, the arithmetic unit performs interpolation in accordance with the distance from the coordinates of the image data specified by the X-coordinate data and the Y-coordinate data to each of the specified pairs of reference coordinates corresponding to the read first compensation data. With the arrangement described above, the coordinates of image data at a certain timing in a display region can be specified by X and Y-coordinate data. By interpolating, according to the coordinates, first compensation data corresponding to pairs of reference coordinates near the coordinates, second compensation data corresponding to the coordinates can be generated. It is thus possible to properly compute compensation data according to each pixel corresponding to the image data.

According to this arrangement, it is preferable that the memory, the interpolation processor, the X counter, and the Y counter be shared among RGB colors. Preferably, the compensation table, the arithmetic unit, the address generator, and the adder are provided in association with each of the RGB colors. With the arrangement described above, it is unnecessary to provide the memory, the interpolation processor, the X counter, and the Y counter for each color. Thus, the configuration can be simplified.

According to the second aspect of the invention, preferably the pixel includes a liquid crystal capacitor formed of two electrodes and liquid crystals provided therebetween. Preferably, the specific levels to which the reference compensation data correspond include first and second levels corresponding to first and second points at which a display characteristic curve indicating transmissivity or reflectivity with respect to the effective value of a voltage applied to the liquid crystal capacitor suddenly changes and at least one level between the first and second levels.

Preferably, the interpolation processor interpolates the reference compensation data to generate the first compensation data corresponding to levels ranging from the first level to the second level. For the first compensation data corresponding to levels below the first level, it is preferable that the interpolation processor uses the reference compensation data corresponding to the first level. For the first compensation data corresponding to levels exceeding the second level, it is preferable that the interpolation processor uses the reference compensation data corresponding to the second level. Preferably, the compensation table stores the first compensation data for levels ranging from the first level to the second level. Preferably, the reading unit selects data corresponding to the first level from the first compensation data stored in the compensation table when the level of the image data is below the first level. When the level of the image data is within a range between the first level and the second level, it is preferable that the reading unit selects data which is generated in accordance with the level of the image data. When the level of the image data exceeds the second level, it is preferable that the reading unit selects data corresponding to the second level. A display characteristic of a liquid crystal capacitor has two points at which the display characteristic greatly changes. Within a range between the two points, the gradient of transmissivity with respect to an applied voltage is steep but approximately constant. In the other ranges, the gradient of transmissivity with respect to the applied voltage is small. For the first compensation data corresponding to levels ranging from the first level to the second level, it is sufficient to use data generated by interpolating reference compensation data. When the level of the image data is below the first level, it is sufficient to select the first compensation data corresponding to the first level. When the level of the image data exceeds the second level, it is sufficient to select the first compensation data corresponding to the second level.

When the level of the image data is below the first level or exceeds the second level, compensation data corresponding to the level of the image data can be generated preferably in the following manner. Specifically, when the level of the image data is below the first level or exceeds the second level, the image data compensation circuit may include a coefficient output unit that outputs a coefficient in accordance with the difference between the level of the image data and the first or second level and a multiplier that multiplies the read first compensation data corresponding to the first or second level by the coefficient output from the coefficient output unit. Preferably, the arithmetic unit performs interpolation according to the coordinates by using the product from the multiplier as the first compensation data which is selectively read by the reading unit. With the arrangement described above, even when the level of the image data is below the first level or exceeds the second level, it is possible to properly generate compensation data corresponding to the level of the image data. Thus, deterioration of the display quality can be reduced, minimized or prevented more precisely.

The coefficient output unit in accordance with the arrangement may include a look up table that stores coefficients corresponding at least to two levels in a region in which the level of the image data is below the first level or in a region in which the level of the image data exceeds the second level; and a coefficient interpolating unit that interpolates the coefficients stored in the look up table and computing a coefficient corresponding to the image data. With the arrangement described above, it is unnecessary to store coefficients in the look up table in association with levels in the region in which the level of the image data is below the first level or in the region in which the level of the image data exceeds the second level. This enables the storage capacity required in the look up table to be reduced.

According to the second aspect of the invention, to meet the demands for color displays, it is preferable that the image data and the reference compensation data correspond to each of the RGB colors. Preferably, the interpolation processor generates the first compensation data in association with each of the RGB colors. Preferably, the compensation table, the arithmetic unit, and the adder are provided in association with each of the RGB colors. With this arrangement, second compensation data as compensation data for image data can be generated according to each of the RGB colors.

Since human vision characteristics are such that sensitivity to G is greater than to R or to B, it is preferable that the amount of reference compensation data for G be larger than that for R or for B. Accordingly, compared with reference compensation data for G, the amount of reference compensation data for R or for B can be relatively reduced. On this account, the storage capacity required in a memory can be reduced.

Preferably, the reference coordinates corresponding to the reference compensation data for R or B are extracted from the reference coordinates corresponding to the reference compensation data for G based on specific rules.

In order to achieve the foregoing objects, an image data compensation circuit according to a third aspect of the invention converts image data, indicating the gray levels of pixels aligned in the form of a matrix in the X direction and the Y direction, into analog data and compensates the image data when a voltage signal is supplied to each of the pixels. The polarity of the voltage signal is inverted on the basis of a predetermined constant potential every predetermined period. The image data compensation circuit includes a memory that stores white reference compensation data which corresponds to a white reference level, black reference compensation data which corresponds to a black reference level, and at least one piece of intermediate reference compensation data which corresponds to a level between the white reference level and the black reference level; a first compensation data generator that interpolates the pieces of reference compensation data in the memory in the level directions based on half tone image data of the image data in one polarity and generating first compensation data; a second compensation data generator that interpolates coordinate data for the half tone image data and the first compensation data in the coordinate direction and generating second compensation data; and an adder that adds second compensation data to the half tone image data, whereby the half tone image data is compensated.

According to the present invention, it is sufficient to consequently make the effective voltage in one polarity to be equal to the effective voltage in the other polarity in a region in which the gray level of a pixel is intermediate (gray).

Preferably, when the image data in one polarity is at the white or black reference level, the first compensation data generator uses the white reference compensation data or the black reference compensation data in the memory as the first compensation data.

According to the present invention, since image data at the white or black reference level causes only a slight change in transmissivity, it is unnecessary to perform interpolation.

When the image data in one polarity is at the white or black reference level, it is preferable that the first compensation data generator use the product of the white reference compensation data or the black reference compensation data in the memory and a coefficient in accordance with the difference between the image data at the white or black reference level and the white reference compensation data or the black reference compensation data in the memory as the first compensation data.

With the arrangement described above, it is possible to properly reduce, minimize or prevent deterioration of the display quality due to flickering or the like.

Preferably, the intermediate reference compensation data in the memory is computed based on a deficiency or an excess of luminance level in positive polarity and negative polarity in a region generated by dividing a screen.

In order to achieve the foregoing objects, a liquid crystal display according to a fourth aspect of the invention includes a memory that stores reference compensation data corresponding to specific levels among levels available to image data, indicating the gray levels of pixels aligned in the form of a matrix in the X direction and the Y direction, for each pair of reference coordinates preset in a display region in which the pixels are aligned; an interpolation processor that interpolates the reference compensation data stored in the memory in the level directions and generating first compensation data corresponding to the levels available to the image data for each pair of reference coordinates; a compensation table that stores the first compensation data in association with the reference coordinates and the levels; a reading unit for selectively reading, from the first compensation data stored in the compensation table, pieces of data which correspond to pairs of reference coordinates positioned near the coordinates of the pixel corresponding to the image data and which correspond to the level of the image data; an arithmetic unit that interpolates the read first compensation data in the coordinate directions and generating second compensation data corresponding to the image data; an adder that adds the second compensation data to the image data at least in one of a case in which a voltage signal is positive and a case in which the voltage signal is negative with respect to a predetermined potential, whereby the image data is compensated; a D/A converter that converts the compensated image data into analog data; a polarity inverter circuit that inverts the polarity of the voltage signal on the basis of the predetermined potential every predetermined period; and a driving circuit that supplies the inverted voltage signal to each of the pixels. Arranged as described above, as in the first and second aspects of the invention, compensation data is generated while writing polarities and a coordinate position corresponding to image data are taken into consideration. It is thus possible to properly reduce, minimize or prevent deterioration of the display quality due to burn-in or flickering for each of pixels aligned in the form of a matrix and to reduce the capacity required in a memory, whereby the configuration can be simplified.

An electronic apparatus according to the present invention includes the foregoing liquid crystal display. When the electronic apparatus is used as a projector that enlarges and projects an image, image data can be compensated so as to reduce, minimize or prevent, for instance, flickering for each pixel, thereby providing advantages. The electronic apparatus is also suitable for a display unit of a direct-viewing type electronic apparatus, such as a mobile computer or a cellular phone.

BRIEF DESCRIPTION OF THE DRAWINGS

FIG. 9 is a chart that illustrates storage contents of a ROM in the compensation level output unit in the projector;

FIG. 11 is a chart that illustrates the storage contents of a compensation table in the compensation level output unit;

FIG. 13(*b*) is a voltage waveform diagram illustrating prevention of burn-in in the first embodiment; and FIG. 13(*c*) is a voltage waveform diagram showing a state in which the effective voltage at the positive polarity side and the effective voltage at the negative polarity side are balanced;

FIG. 16 is a table that illustrates storage contents of a ROM in the compensation level output unit;

FIG. 17 is a table that illustrates storage contents of a compensation table which corresponds to R in the compensation level output unit;

DETAILED DESCRIPTION OF PREFERRED EMBODIMENTS

Embodiments of the present invention are described hereinafter with reference to the drawings.

1 First Embodiment

According to a first embodiment of the present invention, a projector that synthesizes a transmission image using liquid crystal panels and enlarges and projects the synthesized transmission image is described.

1-1 Configuration of Projector

Figure 1:
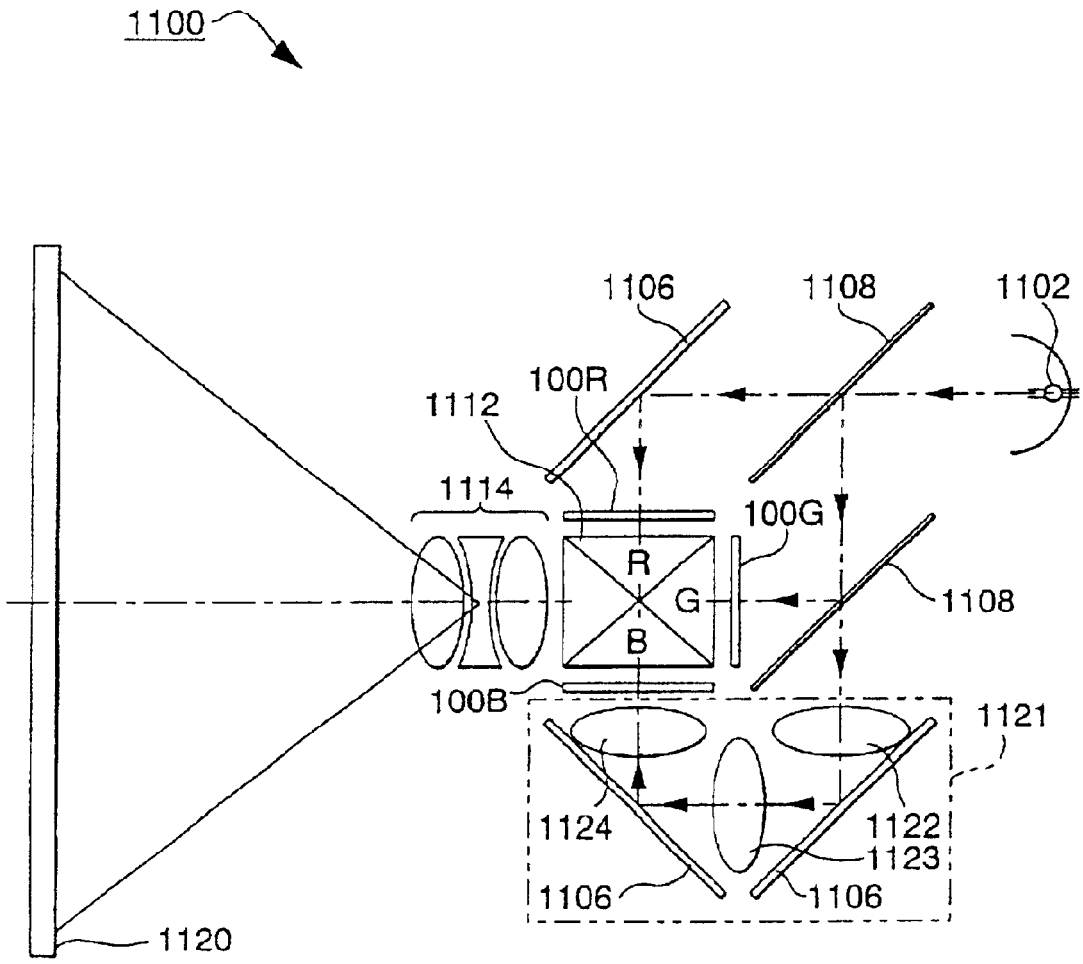
FIG. 1 is a plan view of the configuration of a projector according to a first embodiment of the present invention.

In order to simplify the description, the configuration of the projector is schematically described. FIG. 1 is a plan view of the configuration of the projector. As shown in the drawing, a projector 1100 contains therein a lamp unit 1102, which is formed of a white light source, such as a halogen lamp. Incident light emitted from the lamp unit 1102 is separated into the primary colors R (red), G (green), and B (blue) by three mirrors 1106 and two dichroic mirrors 1108, which are arranged in the projector 1100, and the separated light rays enter liquid crystal panels 100R, 100B, and 100G, respectively, which correspond to the primary colors.

Image signals which correspond to R, G, and B are supplied from a processing circuit 300 (described below) to the liquid crystal panels 100R, 100B, and 100G, respectively. Accordingly, the liquid crystal panels 100R, 100B, and 100G function as light modulators that generate images in the primary colors R, G, and B.

Light modulated by the liquid crystal panels 100R, 100B, and 100G enter a dichroic prism 1112 from three directions. In the dichroic prism 1112, the R and B light beams are refracted 90 degrees, while the G light beam travels straight. Accordingly, an image formed by combining these primary color images is projected onto a screen 1120 by a projection lens 1114. Since the light beams which correspond to the primary colors R, G, and B enter the liquid crystal panels 100R, 100G, and 100B through the dichroic mirror 1108, as described above, it is unnecessary to provide color filters, whereas color filters are necessary in a direct-viewing-type panel.

1-2 Electrical Configuration of Projector

Figure 2:
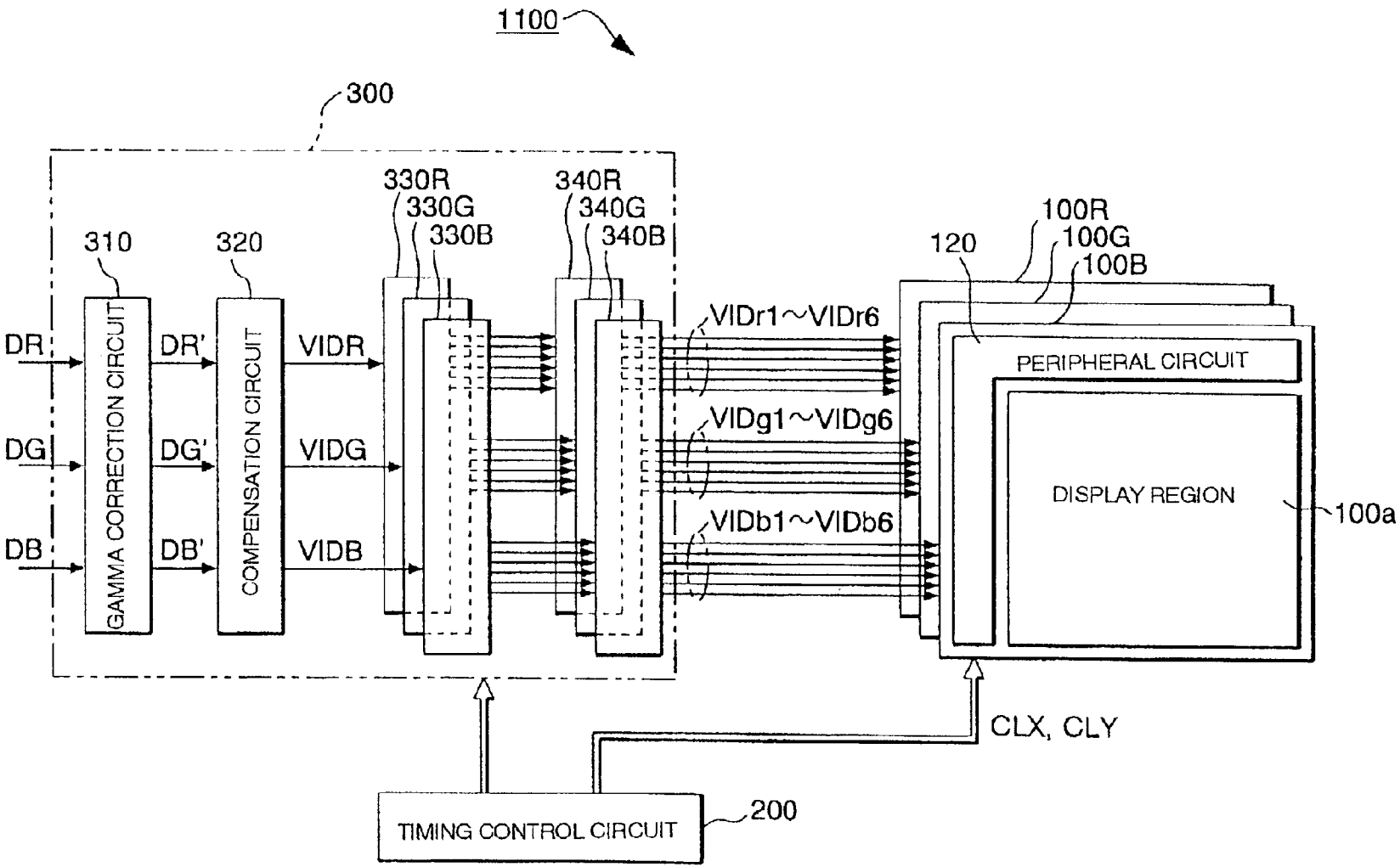
FIG. 2 is a block diagram showing the configuration of the projector.

The electrical configuration of the projector 1100 will now be described. FIG. 2 is a block diagram showing the electrical configuration of the projector 1100.

As shown in FIG. 2, the projector 1100 contains the three liquid crystal panels 100R, 100G, and 100B; a timing control circuit 200; and a processing circuit 300. Among these components, the timing control circuit 200 generates timing signals and clock signals that control sections in accordance with a vertical scanning signal Vs, a horizontal scanning signal Hs, and a dot clock signal DCLK, all of which are supplied from a high-level apparatus.

The processing circuit 300 contains a gamma correction circuit 310; a compensation circuit 320; S/P (serial-parallel) converter circuit 300R, 330G, and 330B; and inverting amplifier circuits 340R, 340G, and 340B.

Among these components, the gamma correction circuit 310 performs gamma correction so that digital image data DR, DG, and DB, which are supplied in accordance with R, G, and B, correspond to display characteristics of the liquid crystal panels 100R, 100G, and 100B, and outputs image data DR', DG', and DB', respectively.

With respect to each color and each pixel, the compensation circuit 320 compensates the image data DR', DG', and DB' so as to reduce, minimize or prevent flickering. The compensated data is subjected to D/A conversion and output as image signals VIDR, VIDG, and VIDB. The compensation circuit 320 will be described in detail below.

The S/P converter circuit 330R, which corresponds to R, receives a one-system of image signal VIDR, and distributes it into six systems. At the same time, the S/P converter circuit 330R performs time-based prolongation (serial-parallel conversion) of the image signals so that they are six times as long as the original image signals, and outputs the resultant image signals (see FIG. 4). The image signal VIDR is converted into image signals of six systems in order to allow a sampling switch 151 (see FIG. 3), which will be described below, to prolong time in which the image signals are applied, thereby ensuring sufficient image-signal sampling time and charge-discharge time. Since this is not directly related to the present invention, a more detailed description thereof is omitted.

The inverting amplifier circuit 340R, which corresponds to R, inverts the polarity of the image signals, amplifies the image signals, and supplies the resultant image signals as image signals VIDr1 to VIDr6 to the liquid crystal panel 100R.

Concerning processing by the compensation circuit 320 of the image signal VIDG, which corresponds to G, similarly, the image signal VIDG is converted by the S/P converter circuit 330G into six systems. Subsequently, the image signals are inverted and amplified by the inverting amplifier circuit 340G, and the resultant image signals are supplied as image signals VIDg1 to VIDg6 to the liquid crystal panel 100G. Similarly, the image signal VIDB, which corresponds to B, is converted into six systems by the S/P converter circuit 330B. Subsequently, the image signals are inverted and amplified by the inverting amplifier circuit 340B, and the resultant image signals are supplied as image signals VIDb1 to VIDb6 to the liquid crystal panel 100B.

The polarity inversion by the inverting amplifier circuits 340R, 340G, and 340B causes the voltage level of an image signal to be alternately inverted on the basis of a constant potential Vc. The determination as to whether to invert the polarity of an image signal is performed in accordance with a method of applying the image signal to a data line: (1) polarity inversion in scanning line units, (2) polarity inversion in data line units, or (3) polarity inversion in pixel units. The inversion period is set to one horizontal scanning period or to a dot clock period. In order to simplify the description, it is assumed hereinafter that the method is (1) polarity inversion in scanning line units. However, methods (2) and (3) can also be used.

1-2-1 Liquid Crystal Panel

Figure 3:
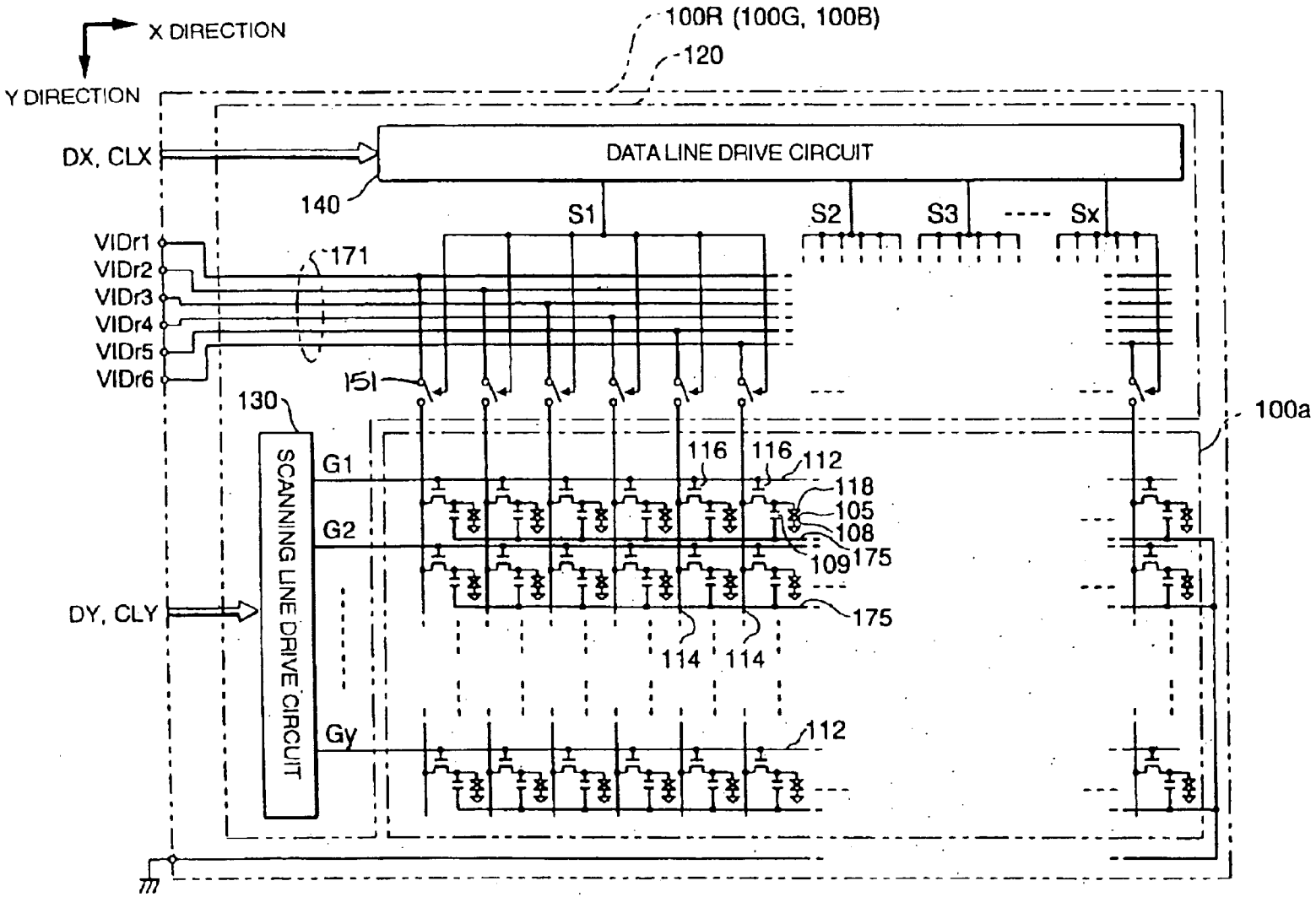
FIG. 3 is a circuit diagram showing the configuration of a liquid crystal panel in the projector.

The configuration of the liquid crystal panels 100R, 100G, and 100B will now be described. Since the liquid crystal panels 100R, 100G, and 100B have the same electrical configuration, the liquid crystal panel 100R, which corresponds to R, is described as an example. FIG. 3 is a block diagram showing the configuration of the liquid crystal panel 100R.

As shown in FIG. 3, in a display region 100*a* of the liquid crystal panel 100R, a plurality of scanning lines 112 is formed parallel to one another, extending in the row (X) direction. Also, a plurality of data lines 114 is formed parallel to one another, extending in the column (Y) direction. At the intersections of the scanning lines 112 and the data lines 114, the gates of TFTs 116, which are switching elements, are connected to the corresponding scanning lines 112; the sources of the TFTs 116 are connected to the corresponding data lines 114; and the drains of the TFTs 116 are connected to rectangular transparent pixel electrodes 118.

The pixel electrodes 118 are opposed to counter electrodes 108. Liquid crystal 105 is filled between each pixel electrode 118 and each counter electrode 108. Specifically, a liquid crystal capacitor is formed by the liquid crystal 105 filled between the pixel electrode 118 and the counter electrode 108.

Figure 4:
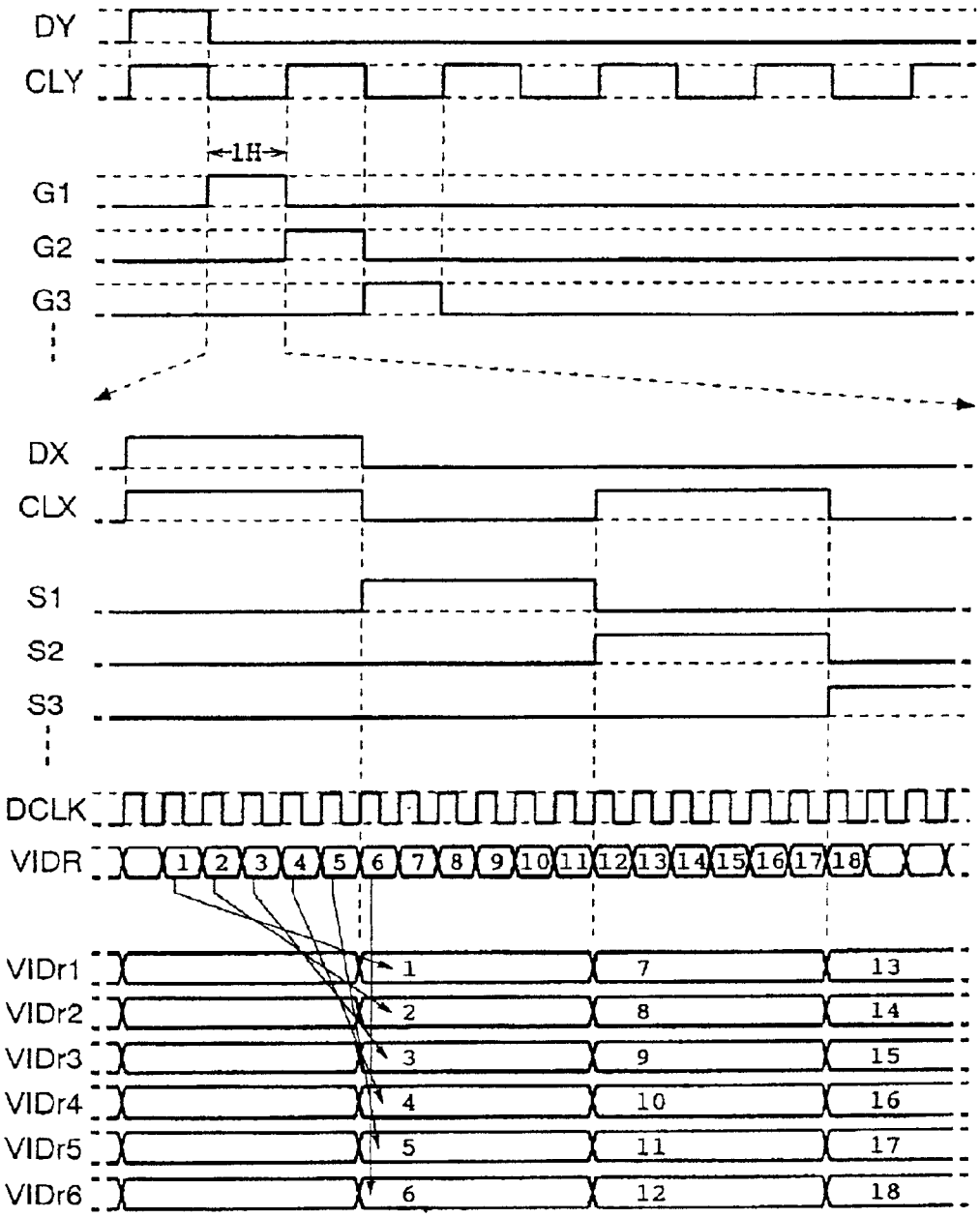
FIG. 4 is a timing chart for illustrating the operation of the liquid crystal panel.

Around the display region 100*a*, a peripheral circuit 120 which contains a scanning line drive circuit 130, a data line drive circuit 140, and the sampling switch 151, is provided. Among these components, as shown in FIG. 4, the scanning line drive circuit 130 sequentially shifts a transfer pulse DY, which is supplied at the start of a vertical scanning period every time the logic level of a clock signal CLY changes (rises or falls), and supplies scanning signals G1, G2, G3, . . . , Gy, which exclusively become the ON potential every horizontal scanning period H to the corresponding scanning lines 112.

The data line drive circuit 140 outputs sampling control signals S1, S2, . . . , Sx, which sequentially become the ON potential in a horizontal scanning period. Specifically, as shown in FIG. 4, the data line drive circuit 140 sequentially shifts a transfer pulse DX, which is supplied at the start of a horizontal scanning period every time the logic level of a clock signal CLX changes, and outputs the sampling control signals S1, S2, S3, . . . , Sx so that they exclusively become the ON potential.

The image signals VIDr1 to VIDr6 are supplied through six image signal lines 171 and sampled with respect to the data lines 114 in accordance with the sampling control signals S1, S2, S3, . . . , Sx.

Specifically, the data lines 114 are grouped in blocks of six lines. In FIG. 3, among six data lines 114, which belong to the i-th block (i=1, 2, . . . , n) from the left, the sampling switch 151 connected to one end of the leftmost data line 114 samples the image signal VIDr1, which is supplied via the image signal line 171 when a sampling signal Si becomes the ON-state voltage, and supplies the sampled image signal VIDr1 to the data line 114.

Among the six data lines 114, which belong to the i-th block, the sampling switch 151 connected to one end of the second data line 114 samples the image signal VIDr2 when the sampling signal Si becomes the ON-state potential, and supplies the sampled image signal VIDr2 to the data line 114. In a similar manner, each sampling switch 151 connected to one end of each of the third, fourth, fifth, and sixth data lines 114 among the six data lines 114, which belong to the i-th block, samples the corresponding image signal VIDr3, VIDr4, VIDr5, and VIDr6 when the sampling signal Si becomes the ON-state potential, and each sampling switch 151 supplies the sampled image signal to the corresponding data line 114.

Storage capacitors 109 are provided in parallel with the liquid crystal capacitors in the display region 100*a*, so as to assist the liquid crystal capacitors in storing electrical charge. More specifically, one end of each of the storage capacitors 109 is connected to the pixel electrode 118 (drain of the TFT 116), while the other end is commonly connected by a capacitance line 175. The capacitance line 175 is commonly grounded at a constant potential (such as potential LCcom, On potential Vdd, and OFF potential Vss).

1-2-2 Compensation Circuit

Figure 5:
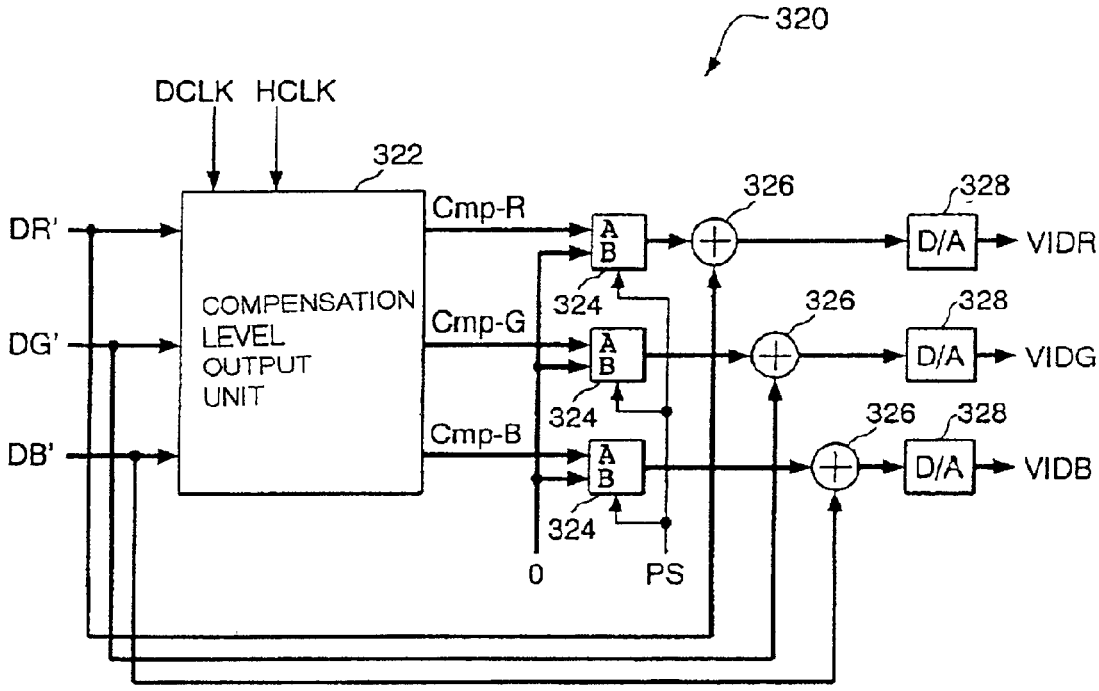
FIG. 5 is a block diagram showing the configuration of a compensation circuit in the projector.

The configuration of the compensation circuit 320 shown in FIG. 2 will now be descried in detail. FIG. 5 is a block diagram showing the configuration of the compensation circuit 320.

In FIG. 5, a compensation level output unit 322 outputs compensation data Cmp-R, Cmp-G, and Cmp-B, which correspond to the digital image data DR', DG', and DB', respectively, in accordance with coordinate positions in the display region 100*a*. The compensation level output unit 322 will be described in more detail below.

When the compensated image signals VIDR, VIDG, and VIDB are to be supplied in accordance with positive polarity writing, a signal PS becomes the H level. In contrast, when the compensated image signals VIDR, VIDG, and VIDB are to be supplied in accordance with negative polarity writing, the signal PS becomes the L level.

Selectors 324, which correspond to the RGB colors, respectively, each select an input port A if the signal PS is at the H level. In contrast, if the signal PS is at the L level, the selectors 324 each select an input port B. The compensation data Cmp-R, Cmp-G, and Cmp-B are supplied to the corresponding input ports A of the selectors 324, while zero data is supplied to the input ports B.

Adders 326, which correspond to the RGB colors, respectively, add the data selected by the corresponding selectors 324 to the original image data DR', DG' and DB' and outputs the sum data.

D/A converter 328, which corresponds to the RGB colors, respectively, converts the sum data from the adders 326 into analog data, and outputs the resultant data as compensated image signals VIDR, VIDG, and VIDB, respectively.

With the arrangement described above, when the signal PS is at the H level, that is, when positive polarity writing is performed, the selectors 324 each select the input port A. As a result, the compensation data Cmp-R, Cmp-G, and Cmp-B are added to the image data DR', DG', and DB', respectively. In contrast, when the signal PS is at the L level, that is, when negative polarity writing is performed, the selectors 324 each select the input port B. As a result, zero data is added to the image data DR', DG', and DB', and no substantial compensation is performed.

A deficiency with respect to the effective voltage in negative polarity writing is added in advance as compensation data to the image data in positive polarity writing. Accordingly, in positive polarity writing, the effective voltage in a case in which the image data to which the compensation data is added is converted into analog data and the sum data is written to the liquid crystal capacitor at the positive polarity side is made equal to the effective voltage in a case in which the uncompensated image data is converted into analog data, and the data is written to the liquid crystal capacitor at the negative polarity side.

The compensation level output unit 322 described below can output the compensation data, which corresponds not only to the level of the image data but also to the coordinate position (pixel position) in the image display region 100*a*, thereby suppressing deterioration of the display quality due to flickering.

1-2-2-1 Configuration of Compensation Level Output Unit

Figure 6:
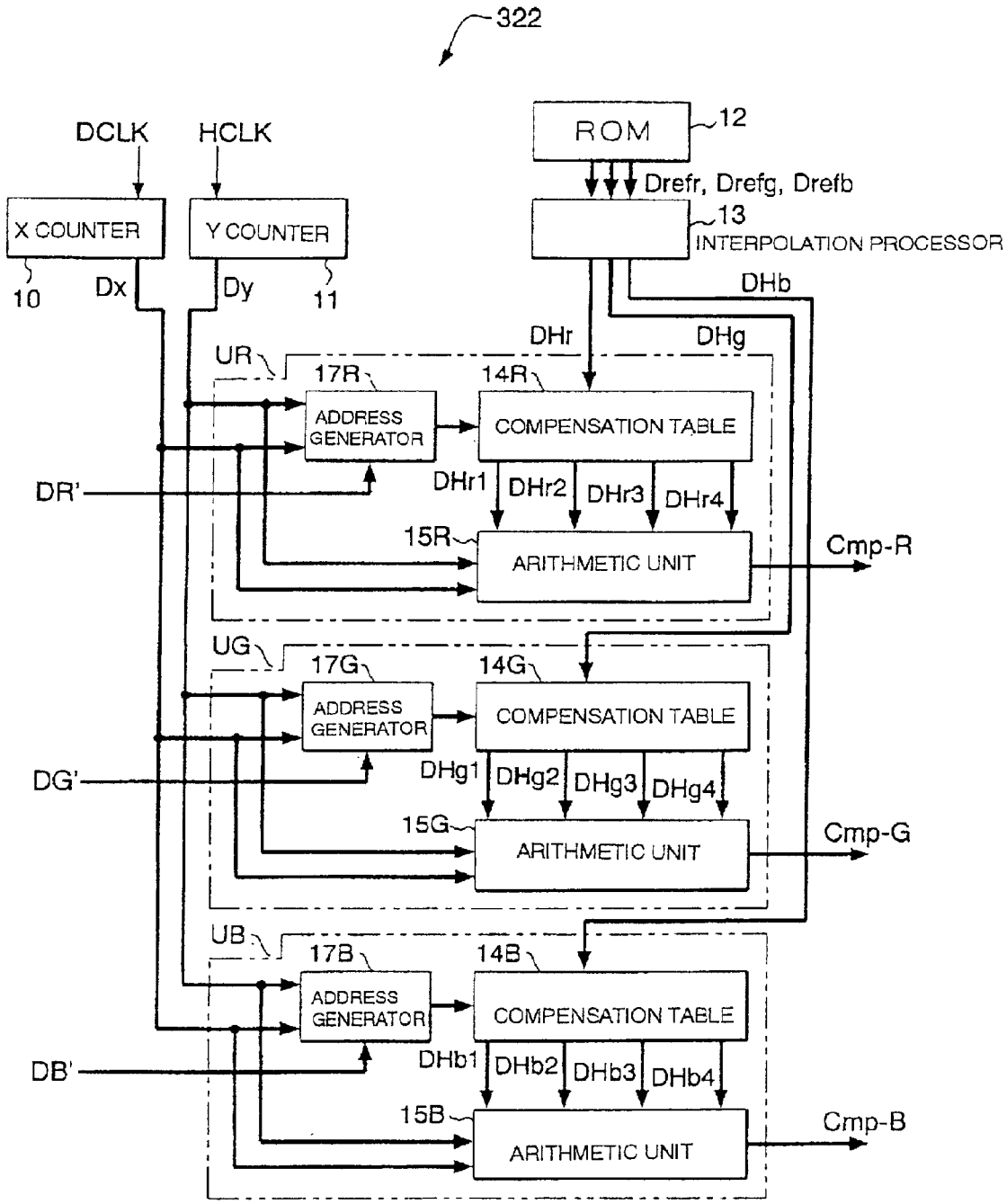
FIG. 6 is a block diagram of the configuration of a compensation level output unit in the compensation circuit.

The compensation level output unit 322 shown in FIG. 5 will now be described in detail. FIG. 6 is a block diagram showing the configuration of the compensation level output unit 322. As shown in FIG. 6, the compensation level output unit 322 contains an X counter 10, a Y counter 11, a ROM (Read Only Memory) 12, an interpolation processor 13, and compensation units UR, RG, and UB.

Among these components, the X counter 10 counts dot clock signals DCLKs which are in synchronization with a period in which image data for 1 dot (pixel) is supplied, and outputs X-coordinate data Dx indicating the X coordinate of the image data. In contrast, the Y counter 11 counts horizontal clock signals HCLKs, which are in synchronization with horizontal scanning, and outputs Y-coordinate data Dy indicating the Y coordinate of the image data. It is thus possible to determine the coordinates of a dot (pixel) corresponding to the image data by referring to the X-coordinate data Dx and the Y-coordinate data Dy.

The above-described clock signal CLY is generated by dividing the horizontal clock signal HCLK into halves. The above-described clock signal CLX is generated by dividing the dot clock signal DCLK into twelfths.

The ROM 12 is a non-volatile memory. When the power supply to the projector 1100 is switched ON, the ROM 12 outputs reference compensation data Drefr, Drefg, and Drefb, which correspond to the RGB colors. The reference compensation data Drefr, Drefg, and Drefb correspond to pairs of predetermined reference coordinates and are used as the basis to compensate for flickering.

Figure 7:
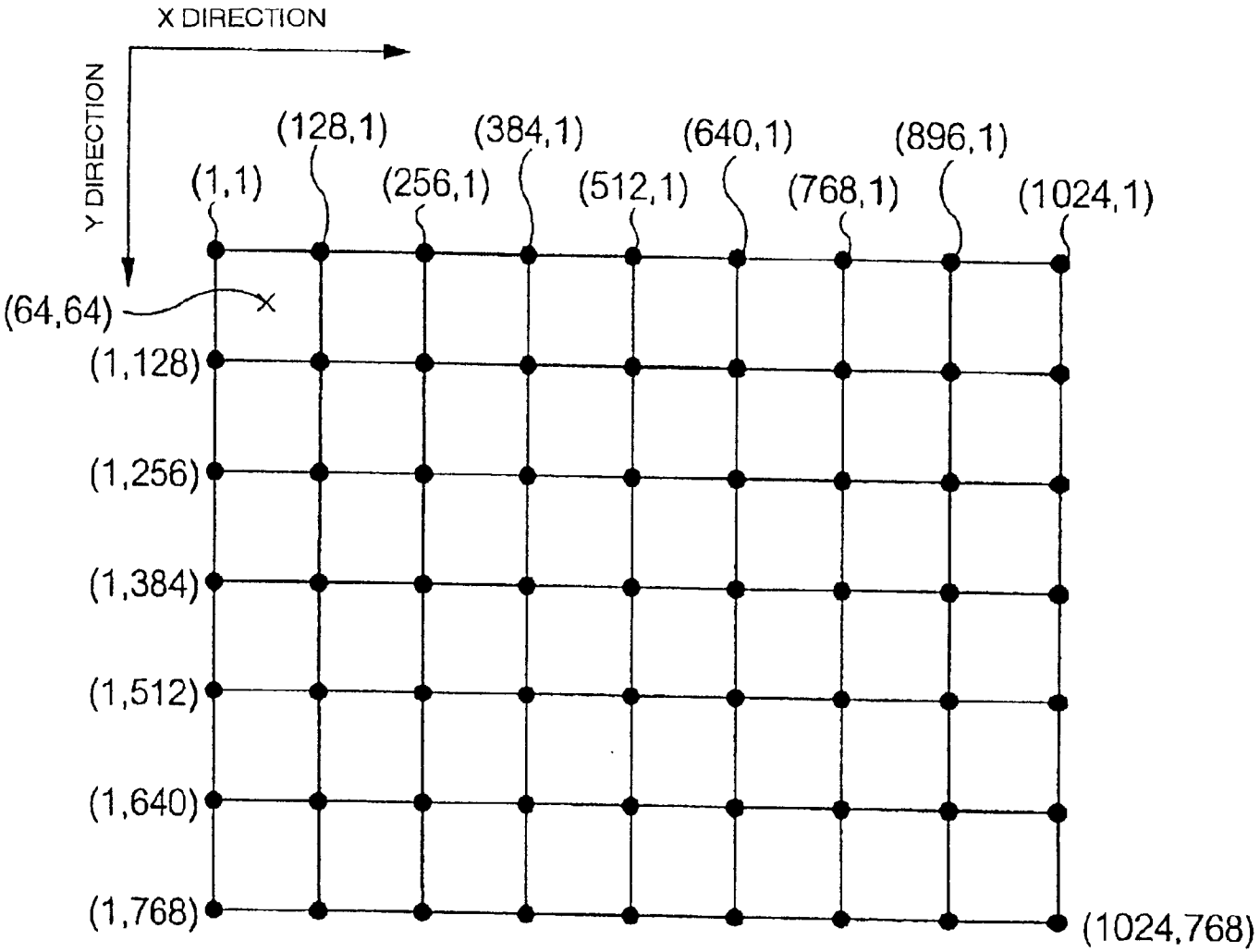
FIG. 7 is a schematic that illustrates the reference coordinates of the first embodiment.

The reference coordinates in the first embodiment are described. FIG. 7 is a conceptual diagram for illustrating the reference coordinates in connection with the display region 100*a*. Assuming, to simplify explanation, that the display region 100*a* in the first embodiment is formed by 1024 dots (row)×768 dots (column), it can be divided into 8 blocks (row)×6 blocks (column). In the first embodiment, a total of 63 coordinate points (indicated by black dots in the drawing) at the apices of these blocks are referred to as reference coordinates.

A specific level for each of the RGB colors is described next. In general, liquid crystal panels have display characteristics in accordance with compositions of liquid crystals. When all levels available to image data are compensated by using compensation data corresponding to a certain level among the data available to the image data, it is impossible to perform accurate compensation. For example, when compensation data optimized at the center (gray) level is used to compensate all the levels available to the image data, it is impossible to perform accurate compensation, particularly at the black level or at the white level. Hence, it is not possible to suppress nonuniformity of luminance at those levels. In contrast, although it would be ideal to store compensation data corresponding to all the levels of image data, the storage capacity required in the ROM 12 would be increased.

Therefore, in the first embodiment, for the RGB colors, the reference compensation data Drefr, Drefg, and Drefb corresponding to three different levels are stored, and compensation data corresponding to levels other than these three levels is obtained by interpolating the stored reference compensation data.

Figure 8:
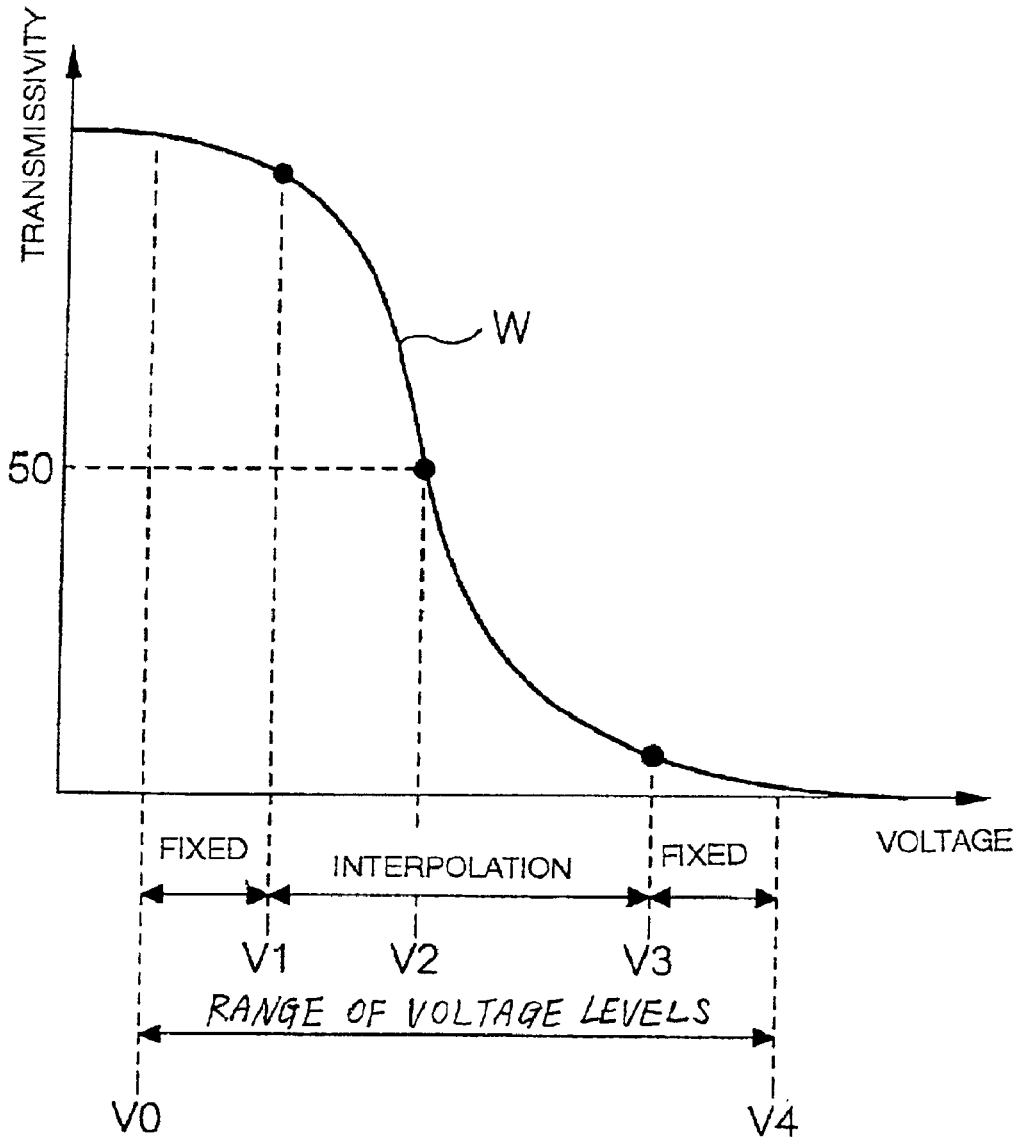
FIG. 8 is a graph that illustrates the relationships among a display characteristic of the liquid crystal panel and three voltage levels corresponding to reference compensation data.

This is described in detail below. FIG. 8 shows a display characteristic W indicating the relationship between transmissivity (or reflectivity) and the effective voltage applied to a liquid crystal capacitor. The voltage levels corresponding to the reference compensation data Dref when the color is not specified are shown. The graph shows a normally white mode in which the transmissivity reaches a maximum (white is displayed) when the effective voltage applied to the liquid crystal capacitor is zero.

As shown in the graph of FIG. 8, concerning the display characteristic W, the transmissivity gradually decreases as the effective voltage applied to the liquid crystal capacitor gradually increases starting from zero. When the effective voltage exceeds voltage level V1, the transmissivity suddenly decreases. When the effective voltage exceeds voltage level V3, the transmissivity gradually decreases. Voltage level V0 is the effective voltage applied to the liquid crystal capacitor when image data is at a minimum level. Voltage level V4 is the effective voltage applied to the liquid crystal capacitor when image data is at a maximum level. Concerning the display characteristic W, the reference compensation data Dref in the first embodiment is set relative to voltage levels V1, V2, and V3 by a technique described hereinafter. Voltage levels V1 and V3 correspond to points at which the display characteristic W suddenly changes. Voltage level V2 corresponds to a point at which the transmissivity becomes approximately 50%.

The reasons for choosing the above-described three voltage levels are described hereinafter. First, in a region below voltage level V1 or in a region above voltage level V3, the change in transmissivity is small, even when the levels of the image data differ greatly. It is therefore concluded that interpolation can be satisfactorily performed by using the reference compensation data Dref corresponding to voltage level V1 or V3. Second, if the reference compensation data Dref corresponding to voltage levels V0 and V4, instead of voltage levels V1 and V3, are stored and compensation data corresponding to each level within the range of voltage levels V0 to V4 is computed by interpolation, it is not possible to accurately compute the compensation data in the entire range, since the display characteristic W suddenly changes at voltage levels V1 and V3. Third, it is possible to enhance the accuracy in interpolation by using voltage level V2 at which the transmissivity becomes approximately 50%.

In the following description, if necessary, voltage level V1 is referred to as a white reference level; voltage level V2 is referred to as the center reference level; and voltage level V3 is referred to as a black reference level. In this example, the reference compensation data Dref are provided in association with the white reference level, the center reference level, and the black reference level. It is also possible to provide reference compensation data Dref corresponding to points separating the range of the white reference level to the black reference level. Thus, the reference compensation data Dref may be prepared in association with the white reference level, a plurality of intermediate reference levels, and the black reference levels.

The storage contents of the ROM 12 are described below. FIG. 9 shows the storage contents of the ROM 12.

As shown in FIG. 9, the ROM 12 stores nine pieces of reference compensation data Dref for each of 63 pairs of reference coordinates. Specifically, the reference compensation data Dref corresponding to a pair of reference coordinates is formed of the reference compensation data Drefr, Drefg, and Drefb, which correspond to the RGB colors, respectively. The reference compensation data for each color is stored further in association with the white reference level, the center reference level, and the black reference level.

Referring to FIG. 9, the first subscripts "R", "G", and "B" following the letter "D" (which indicates data) indicate the color to which the data corresponds. Among the second subscripts, "w" indicates that the data corresponds to the white reference level, "c" indicates that the data corresponds to the center reference level, and "b" indicates that the data corresponds to the black reference level. The third and fourth subscripts "i, j" indicate the corresponding reference coordinates. For example, "DRc256,1" indicates that the reference compensation data corresponds to R (red), to the center reference level, and to the reference coordinates (256,1).

Figure 10:
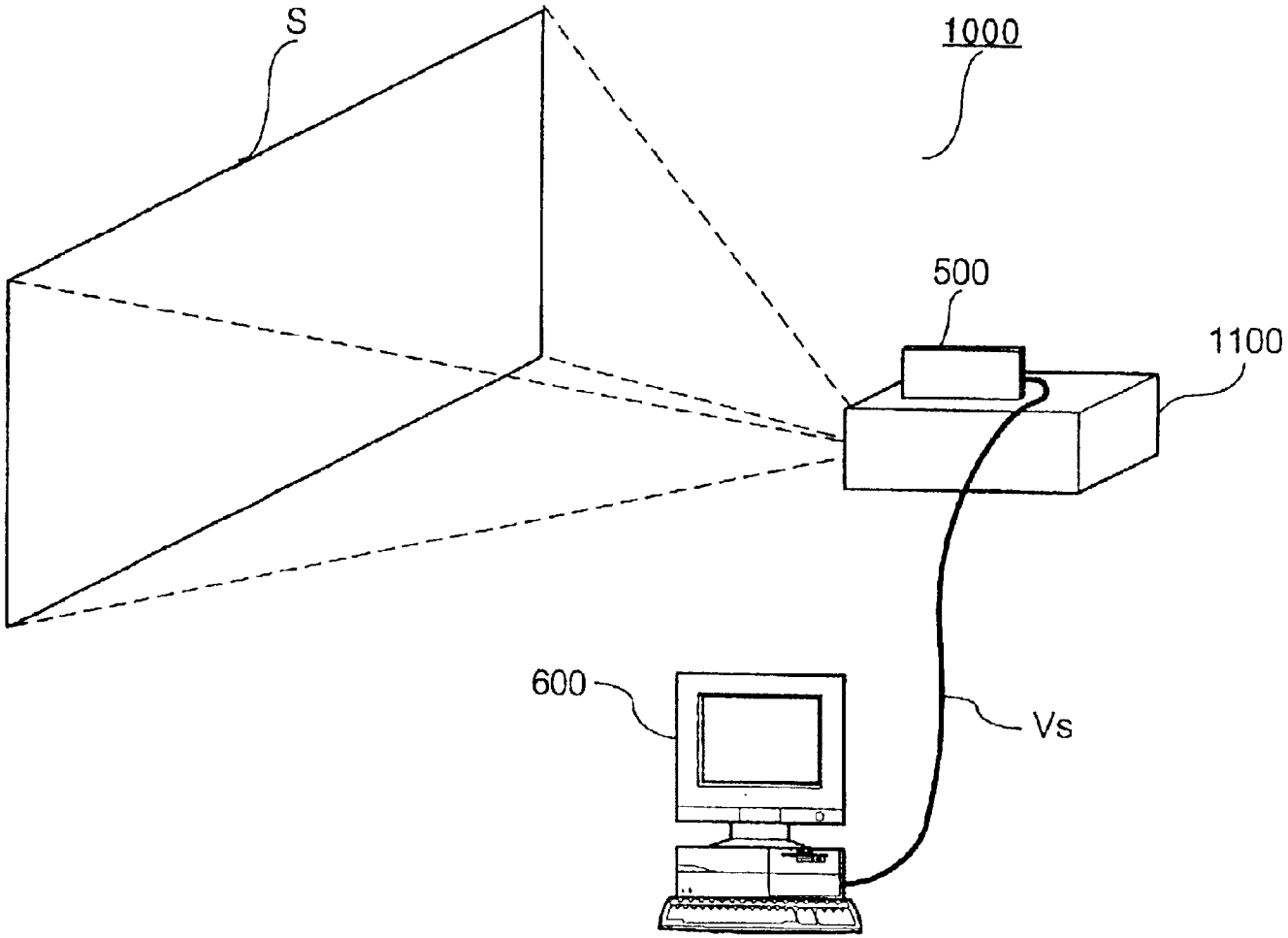
FIG. 10 is a schematic that illustrates the configuration of a system for generating the reference compensation data in the compensation level output unit.

In the following description, concerning the reference compensation data, when distinguished among the RGB colors, the reference compensation data corresponding to R is referred to as Drefr, the reference compensation data corresponding to G is referred to as Drefg, and the reference compensation data corresponding to B is referred to as Drefb. When not distinguished among the RGB colors, the reference compensation data is simply referred to as Dref Setting of the reference compensation data Dref is described next. FIG. 10 shows the configuration of a system used to set the reference compensation data Dref. A system 1000 shown in FIG. 10 includes the projector 1100 according to the first embodiment, a CCD camera 500, a personal computer 600, and a screen S. The compensation circuit 320 is deactivated.

In the system 1000, the CCD camera 500 captures an image projected by the projector 1100 onto the screen S. The CCD camera 500 converts the image and outputs the converted image as an image signal Vs. The personal computer 600 analyzes the image signal Vs and generates reference compensation data Dref by a process described below.

A signal generator (not shown) is connected to the system 1000. Image data DR', which corresponds to R, and voltage level V1 is supplied (concerning image data DG' and DB', they are fixed corresponding to voltage level V4 at which the transmissivity is the lowest). Accordingly, the screen S displays a solid red image by alternation between positive polarity writing and negative polarity writing.

Next, the image is captured by the CCD camera 500, and the captured image is supplied as the image signal Vs to the personal computer 600. Based on the image signal Vs, the personal computer 600 divides a single-frame screen into 6 blocks (column)×8 blocks (row), as shown in FIG. 7, and obtains the average luminance level in each block in positive polarity writing and negative polarity writing. Based on the obtained average luminance levels, the personal computer 600 computes the luminance level at each pair of reference coordinates. Specifically, the personal computer 600 obtains the luminance level at a certain pair of reference coordinates by taking an average of one, two, or four blocks adjacent to those reference coordinates.

Subsequently, the personal computer 600 compares the luminance level at the reference coordinates in positive polarity writing with that in negative polarity writing. When either positive polarity writing or negative polarity writing is selected as the basis, a deficiency or an excess in the other writing is computed. Based on the deficiency or excess, the personal computer 600 computes the reference compensation data Dref. In the first embodiment, negative polarity writing is selected as the basis, and compensation is performed in positive polarity writing. Thus, a deficiency in positive polarity writing with respect to negative polarity writing is computed.

The personal computer 600 performs similar operations for all 63 pairs of the reference coordinates. Similarly, the personal computer 600 further performs the computing operation for the center reference level (voltage level V2) and the black reference level (V3), and computes the reference compensation data Drefr corresponding to R.

Successively, the image data DR' and DB' are fixed corresponding to voltage level V4 at which the transmissivity is the lowest. The image data DG' corresponding to G is sequentially changed so as to correspond to the white reference level, to the center reference level, and to the black reference level. The personal computer 600 is caused to compute the reference compensation data Drefg corresponding to G.

Similarly, the image data DR' and DG' are fixed corresponding to voltage level V4 at which the transmissivity is the lowest. The image data DB' corresponding to B is sequentially changed so as to correspond to the white reference level, the center reference level, and the black reference level. The personal computer 600 is caused to compute the reference compensation data Drefb corresponding to B. The reference compensation data Drefr, Drefg, and Drefb as computed above are stored in the ROM 12 in the projector 1100.

Referring again to FIG. 6, with respect to each of the RGB colors, the interpolation processor 13 interpolates the reference compensation data Drefr, Drefg, and Drefb corresponding to the white reference level, the center reference level, and the black reference level. Accordingly, the interpolation processor 13 computes compensation data (first compensation data) DHr, DHg, and DHb, which correspond to the RGB colors, respectively, with respect to each pair of reference coordinates.

Specifically, the interpolation processor 13 computes the compensation data DHr corresponding to each level ranging from the white reference level to the center reference level based on the reference compensation data Drefr corresponding to voltage level V1 (white reference level) and the reference compensation data Drefr corresponding to voltage level V2 (center reference level). Similarly, the interpolation processor 13 computes the compensation data DHr, corresponding to each level ranging from the center reference level to the black reference level based on the reference compensation data Drefr corresponding to voltage level V2 (center reference level) and the reference compensation data Drefr corresponding to voltage level V3 (black reference level).

The interpolation processor 13 in the first embodiment is configured to compute the compensation data DH by linear interpolation. For example, the compensation data DHr, which corresponds to voltage level Va (V1<Va<V2), to a pair of coordinates (i, j), and to R is provided by the following equation: DHr=(DRwi, j)·(Va−V1)/(V2−V1)+(DRci, j)·(V2−Va)/(V2−V1).

Therefore, the compensation data DHr, DHg, and DHb corresponding to each level ranging from voltage level V1 (white reference level) to voltage level V3 (black reference level) is computed by the interpolation processor 13 for each of 63 pair of reference coordinates.

Next, the compensation unit UR, which corresponds to R, interpolates the compensation data DHr generated by the interpolation processor 13 with respect to the coordinates to output the compensation data Cmp-R, which corresponds to the level and coordinate position of the image data DR'. Similarly, the compensation unit UG, which corresponds to G, interpolates the compensation data DHg with respect to the coordinates to output the compensation data Cmp-G, which corresponds to the level and coordinate position of the image data DG'. The compensation unit UB, which corresponds to B, interpolates the compensation data DHb with respect to the coordinates to output the compensation data Cmp-B, which corresponds to the level and coordinate position of the image data DB'.

Since the compensation units UR, UG, and UB have the same configuration in the first embodiment, the compensation unit UR is described by way of example.

The compensation unit UR includes a compensation table 14R, an arithmetic unit 15R, and an address generator 17R.

Among these components, the compensation table 14R is configured so as to store the compensation data DHr generated by the interpolation processor 13 in a region having the reference coordinates as a row address and the level direction as a column address. At the same time, the compensation table 14R outputs four pieces of compensation data DHr1 to DHr4 from a storage region specified by a read-out address.

The storage contents of the compensation table 14R are described with reference to FIG. 11. In FIG. 11, "m" denotes image data corresponding to voltage level V1, and "n" denotes image data corresponding to voltage level V3. As shown in FIG. 11, the compensation table 14R stores the compensation data DHr in association with the reference coordinates. The first and second subscripts "i, j" following the compensation data DHr indicate the corresponding reference coordinates. The third subscript "the parenthesized number" indicates the level of the corresponding image data. For example, "DHr1,128(m+2)" indicates that the compensation data corresponds to the reference coordinates (1, 128) and to the image data level (m+2).

The address generator 17R successively generates four read-out addresses by a process described below based on the X-coordinate data Dx, the Y-coordinate data Dy, and the image data DR'.

Specifically, the address generator 17R first specifies the reference coordinates of four points positioned in the vicinity of the coordinates specified by the X-coordinate data Dx and the Y-coordinate data Dy. For example, when the coordinates specified by the X-coordinate data Dx and the Y-coordinate data Dy are (64,64) (see FIG. 7), four pairs of reference coordinates (1,1), (128,1), (1,128), and (128,128) are specified. Accordingly, four row addresses designating the first row, the second row, the tenth row, and the eleventh row are generated.

Second, the address generator 17R generates a column address corresponding to the level of the image data DR'. For example, when the level of the image data DR' is "m+1", a column address designating the second column is generated. When the level of the image data DR' falls below "m", a column address designating the first column is generated. When the level of the image data DR' exceeds "n", a column address corresponding to "n" is generated.

Third, the address generator 17R generates four read-out addresses by combining four row addresses and one column address.

Subsequently, the address generator 17R selects the four pieces of compensation data DHr1 to DHr4 from the compensation data DHr stored in the compensation table 14R. For example, when the level of the image data DR' is "m+1" and the coordinates specified by the X-coordinate data Dx and the Y-coordinate data Dy are (64,64), as shown in FIG. 11, "DHr1,1(m+1)", "DHr128,1(m+1)", "DHr1,128(m+1)", and "DHr128, 128(m+1)" are read from the compensation table 14R as the compensation data DHr1 to DHr4.

The arithmetic unit 15R shown in FIG. 6 uses the four pieces of read compensation data DHr1 to DHr4 to compute compensation data Cmp-R that will correspond to the coordinates (coordinates corresponding to the image data DR') specified by the X-coordinate data Dx and the Y-coordinate data Dy by interpolation processing. Specifically, the arithmetic unit 15R performs linear interpolation of the four pieces of compensation data DHr1 to DHr4 in accordance with distances from the coordinates specified by the X-coordinate data Dx and the Y-coordinate data Dy to the coordinates corresponding to the compensation data DHr1 to DHr4, respectively. Hence, the compensation data Cmp-R is computed.

In positive polarity writing, the adder 326 shown in FIG. 5 adds the compensation data Cmp-R to the image data DR', and the resultant data is output as the analog image signal VIDR from the D/A converter 328.

Although a case in which the compensation data Cmp-R corresponding to R is generated has been described, the compensation data Cmp-G, which corresponds to G, or the compensation data Cmp-B, which corresponds to B, can be obtained by similar processing. In positive polarity writing, the compensation data Cmp-G and Cmp-B are added to the image data DG' and DB', respectively, and the resultant data are output as the analog image signals VIDG and VIDB, respectively.

1-2-2-2 Operation of Compensation Circuit

Figure 12:
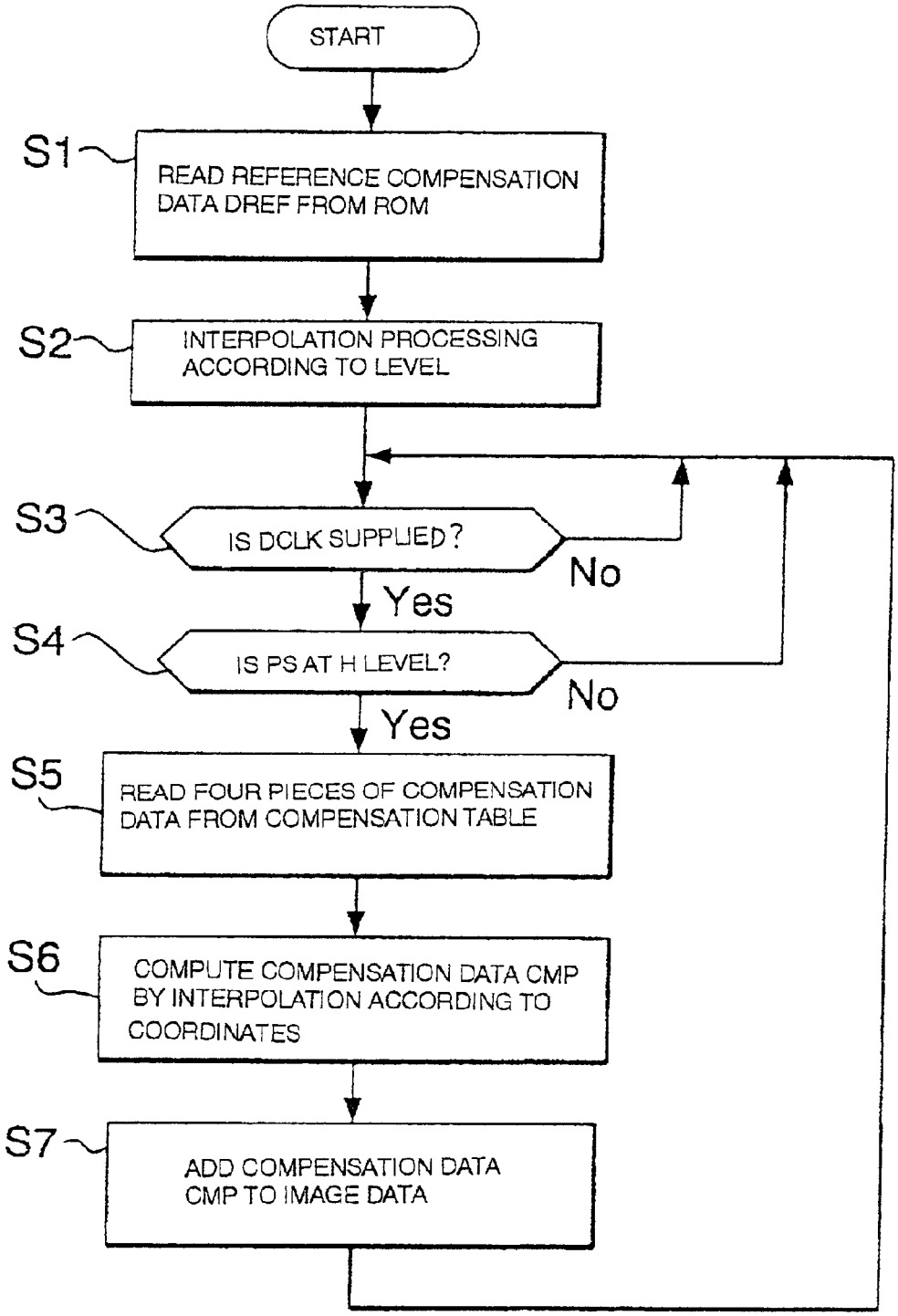
FIG. 12 is a flowchart showing the operation of the compensation circuit.

The operation of the compensation circuit 320 is described. FIG. 12 is a flowchart showing the operation of the compensation circuit 320.

When the power supply to the projector 1100 is switched ON, the reference compensation data Dref (Drefr, Drefg, and Drefb) corresponding to the reference coordinates are read from the ROM 12 (step S1).

Next, the interpolation processor 13 performs interpolation processing according to the level based on the reference compensation data Drefr, Drefg, and Drefb, and generates the compensation data DHr, DHg, and DHb (step S2). Specifically, since the reference compensation data Drefr, Drefg, and Drefb correspond to only three voltage levels V1, V2, and V3 among the 63 reference coordinate pairs, the compensation data DHr, DHg, and DHb corresponding to each level ranging from voltage level V1 to voltage level V3 are generated by interpolation processing.

When the compensation data DHr, DHg, and DHb are stored in the compensation tables 14R, 14G, and 14B, respectively, it is determined whether the image data DR', DG', and DB' for one dot (pixel) are supplied in synchronization with the dot clock signal DCLK and the horizontal clock signal HCLK (step S3). If the determination is negative, the process returns to step S3, and the projector 1100 enters the standby mode.

When the determination is affirmative, on the other hand, in step S3, it is further determined whether the signal PS at this point is at H level (i.e. whether to perform the positive polarity writing)(step S4). In the case that the determination is negative (i.e. the negative polarity writing is to be performed), as in the foregoing description, the selector 324 only adds zero data to the image data DR', DG' and DB', respectively, and thus the process returns to the step S3 and enters the standby mode without performing any practical compensation.

If the determination in step S4 is affirmative, based on the X-coordinate data Dx output from the X counter 10 and the Y-coordinate data Dy output from the Y counter 11, the coordinate positions to which the present image data DR', DG', and DB' correspond in the display region 100*a* are indicated. Concerning R, the compensation data DHr1 to DHr4, which are to be used as the basis for interpolation with respect to the coordinates, are read from the compensation table 14R based on the X-coordinate data Dx, the Y-coordinate data Dy, and the level of the image data DR'. Similarly, concerning G, the compensation data DHg1 to DHg4, which are to be used as the basis for interpolation with respect to the coordinates, are read from the compensation table 14G based on the X-coordinate data Dx, the Y-coordinate data Dy, and the level of the image data DG'. Concerning B, the compensation data DHb1 to DHb4, which are to be used as the basis for interpolation with respect to the coordinates, are read from the compensation table 14B based on the X-coordinate data Dx, the Y-coordinate data Dy, and the level of the image data DB' (step S5).

Subsequently, the compensation data DHr1 to DHr4 are interpolated by the arithmetic unit 15R based on the X-coordinate data Dx and the Y-coordinate data Dy, and the compensation data Cmp-R is generated. Similarly, the compensation data DHg1 to DHg4 are interpolated by the arithmetic unit 15G to generate the compensation data Cmp-G. The compensation data DHb1 to DHb4 are interpolated by the arithmetic unit 15B to generate the compensation data Cmp-B (step S6).

After the compensation data Cmp-R and the image data DR' are added by the adder 324, the resultant data is subjected to analog conversion by the D/A converter 328, and the image signal VIDR for the R (red) color is output. Similarly, after the compensation data Cmp-G and the image data DG' are added, the resultant data is subjected to analog conversion, and the image signal VIDG for the G (green) color is output. After the compensation data Cmp-B and the image data DB' are added, the resultant data is subjected to analog conversion, and the image signal VIDB for the B (blue) color is output (step S7).

Subsequently, the process again returns to step S3 in order to perform similar processing using image data DR' DG', and DB' for the subsequent dot.

Figure 13:
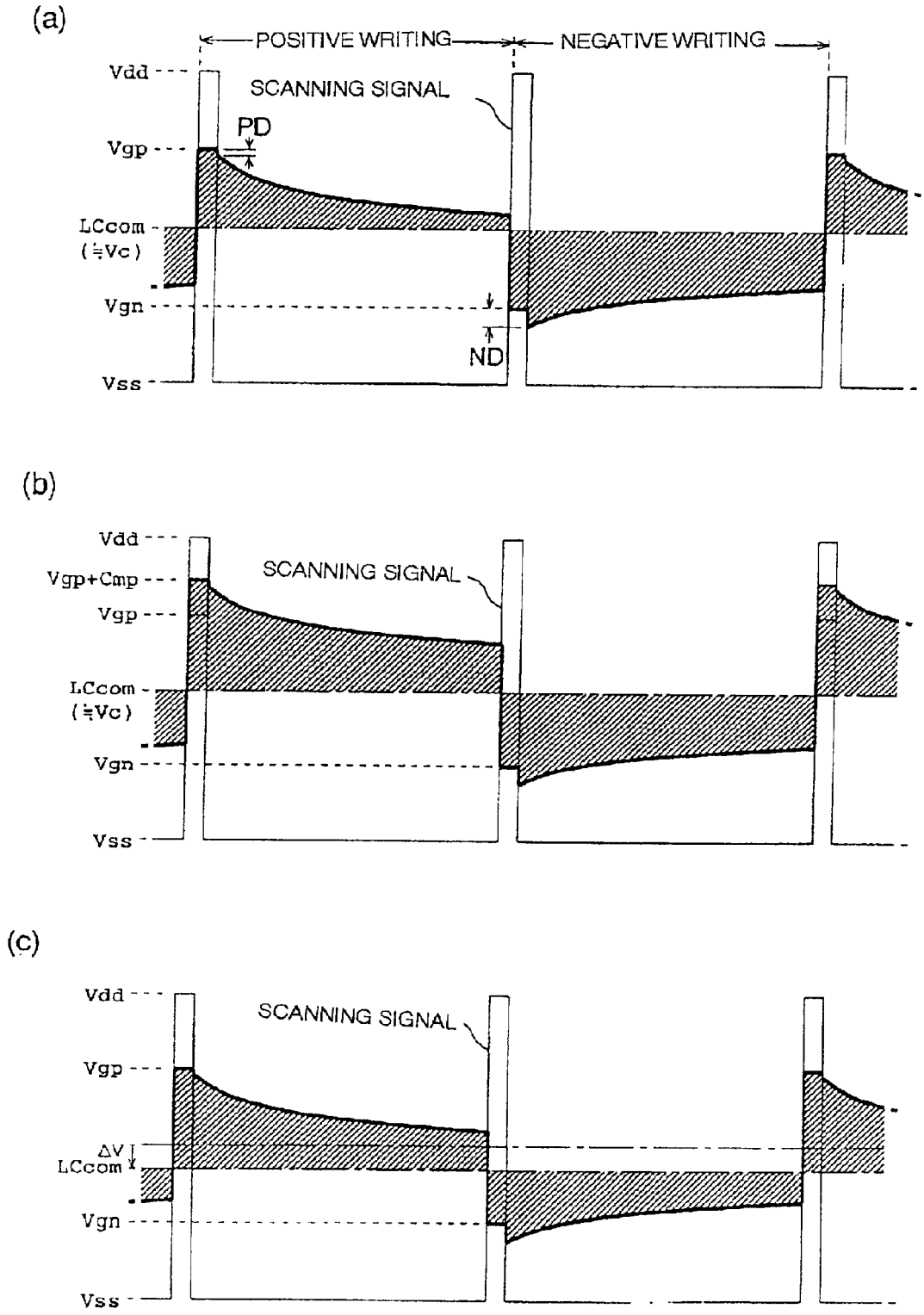
FIG. 13(*a*) is a voltage waveform diagram illustrating application of a DC component to a liquid crystal capacitor.

According to the first embodiment, for example, concerning R, in positive polarity writing, the appropriate compensation data Cmp-R is computed in the whole range of levels of the image data DR', and added to the image data DR'. In contrast, in negative polarity writing, the image data DR' is not substantially compensated. Therefore, the effective voltages applied to a liquid crystal capacitor are approximately the same in both positive and negative polarity writing. For example, as shown in FIG. 13(*b*), in positive polarity writing, application of the sum of a voltage Cmp, which corresponds to the compensation level data Cmp-R and an uncompensated voltage Vgp to a pixel electrode, compensates for a deficiency with respect to the effective voltage in a case in which the voltage Vgn is applied to the pixel electrode in negative polarity writing. As a result, the effective voltages applied to the liquid crystal capacitor are approximately the same in both positive and negative polarity writing, thereby suppressing deterioration of the display quality due to flickering.

According to the compensation circuit 320, concerning R, the compensation data DHr, which corresponds to each level of the image data, is generated for each pair of reference coordinates based on the reference compensation data Drefr, which corresponds to each pair of reference coordinates, and which corresponds to three voltage levels V1, V2, and V3. Also, four pieces of compensation data DHr1 to DHr4 are interpolated in accordance with the X-coordinate data Dx and the Y-coordinate data Dy to generate the compensation data Cmp-R. As a result, compensation according to the level of the image data and to the coordinate position of the image data DR' can be performed, resulting in suppression of deterioration of the display quality due to flickering, in the whole range of the display region 100*a*.

In addition, after interpolation according to the level is performed, interpolation according to the coordinates is performed. In other words, two-step interpolation is performed. Thus, the memory capacity required in the ROM 12 and the compensation table 14R can be greatly reduced.

Since the X counter 10, the Y counter 11, the ROM 12, and the interpolation processor 13 are shared by the compensation units UR, UG, and UB, the configuration can be simplified, and the cost can be reduced.

According to the first embodiment, the compensation circuit 320 is provided subsequent to the gamma correction circuit 310. Needless to say, the order can be reversed, and gamma correction can be performed subsequent to inputting the image data DR, DG, and DB to the compensation circuit 320 to be compensated.

2 Second Embodiment

A projector according to a second embodiment of the present invention will now be described. Since this projector is similar to that of the first embodiment, except for the fact that the compensation level output unit 322 of the compensation circuit 320 in the first embodiment is replaced by a compensation level output unit 322' shown in FIG. 14, repeated descriptions of the common portions are omitted.

2-1 Configuration of Compensation Circuit (Compensation Level Output Unit)

Figure 14:
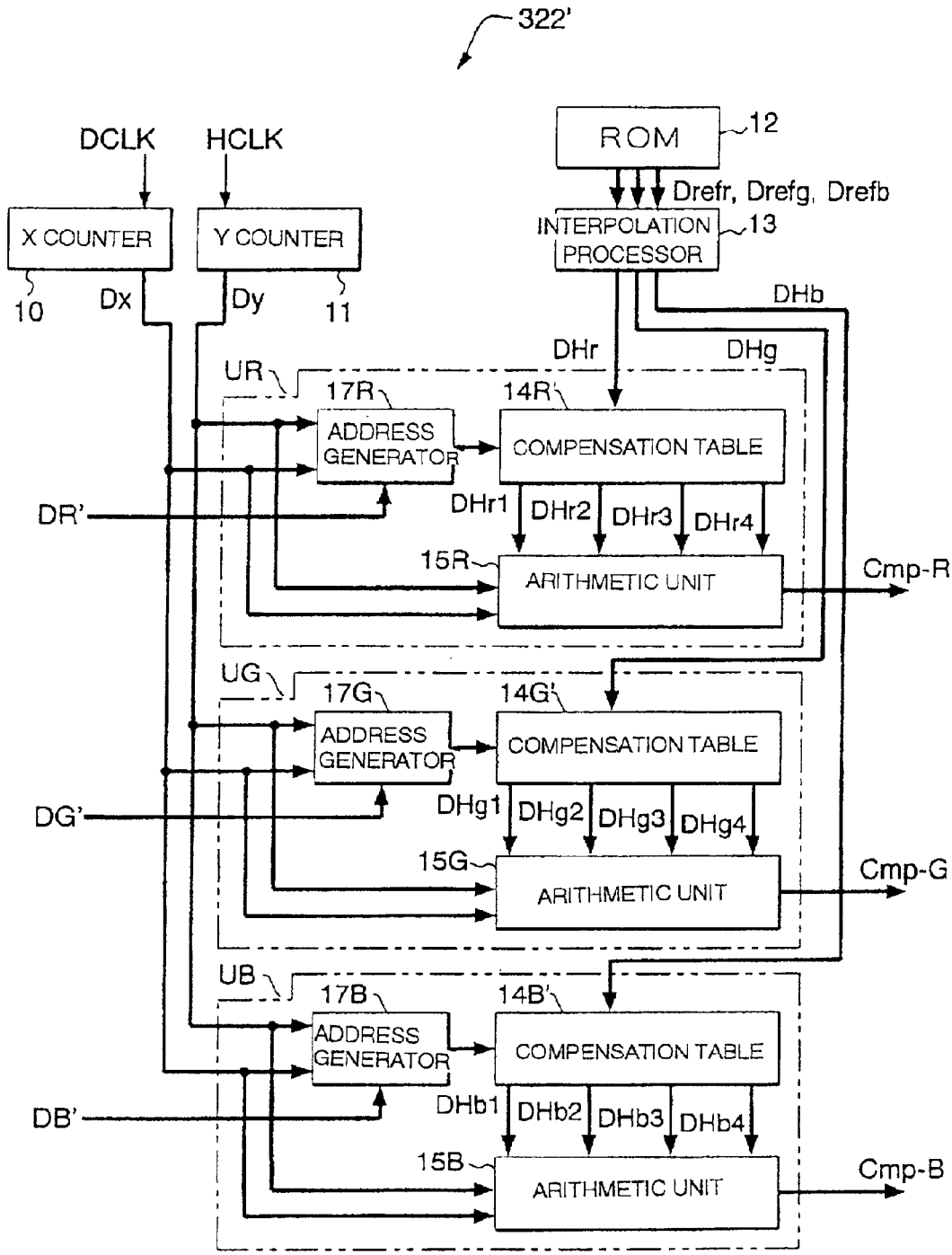
FIG. 14 is a block diagram of the configuration of a compensation level output unit in a projector according to a second embodiment of the present invention.

The compensation level output unit 322' shown in FIG. 14 stores beforehand the reference compensation data Drefr, Drefg, and Drefb. The interpolation processor 13 interpolates the reference compensation data Drefr, Drefg, and Drefb with respect to the level to generate the compensation data DHr, DHg, and DHb, respectively. Based on the compensation data DHr, DHg, and DHb, the compensation data Cmp-R, Cmp-G, and Cmp-B are generated, respectively. This basic mechanism is common to that of the compensation level output unit 322 in the first embodiment (see FIG. 6).

On the contrary, the compensation level output unit 322' in the second embodiment differs from the compensation level output unit 322 in the first embodiment, in that a ROM 12' with a small storage capacity is used instead of the ROM 12, and in that compensation tables 14R' and 14B' with small storage capacities are used instead of the compensation tables 14R and 14B.

Human vision characteristics are such that sensitivity to G (green) is greater than to R (red) or to B (blue). Flickering is more noticeable in G than in R and B. Thus, it is not necessarily required to have the same accuracy in compensating the RGB colors. By reducing the accuracy of compensation in R and B as compared with that in G, it is possible to reduce the required memory capacity.

The second embodiment takes this point into consideration. By setting the ratio among the reference compensation data Drefr, Drefg, and Drefb in accordance with human vision characteristics, the greatest visual advantages are achieved by using the ROM 12' with a limited storage capacity. In the following description, the ROM 12' and the compensation tables 14R' and 14B' used in the compensation level output unit 322' are mainly described.

Figure 15:
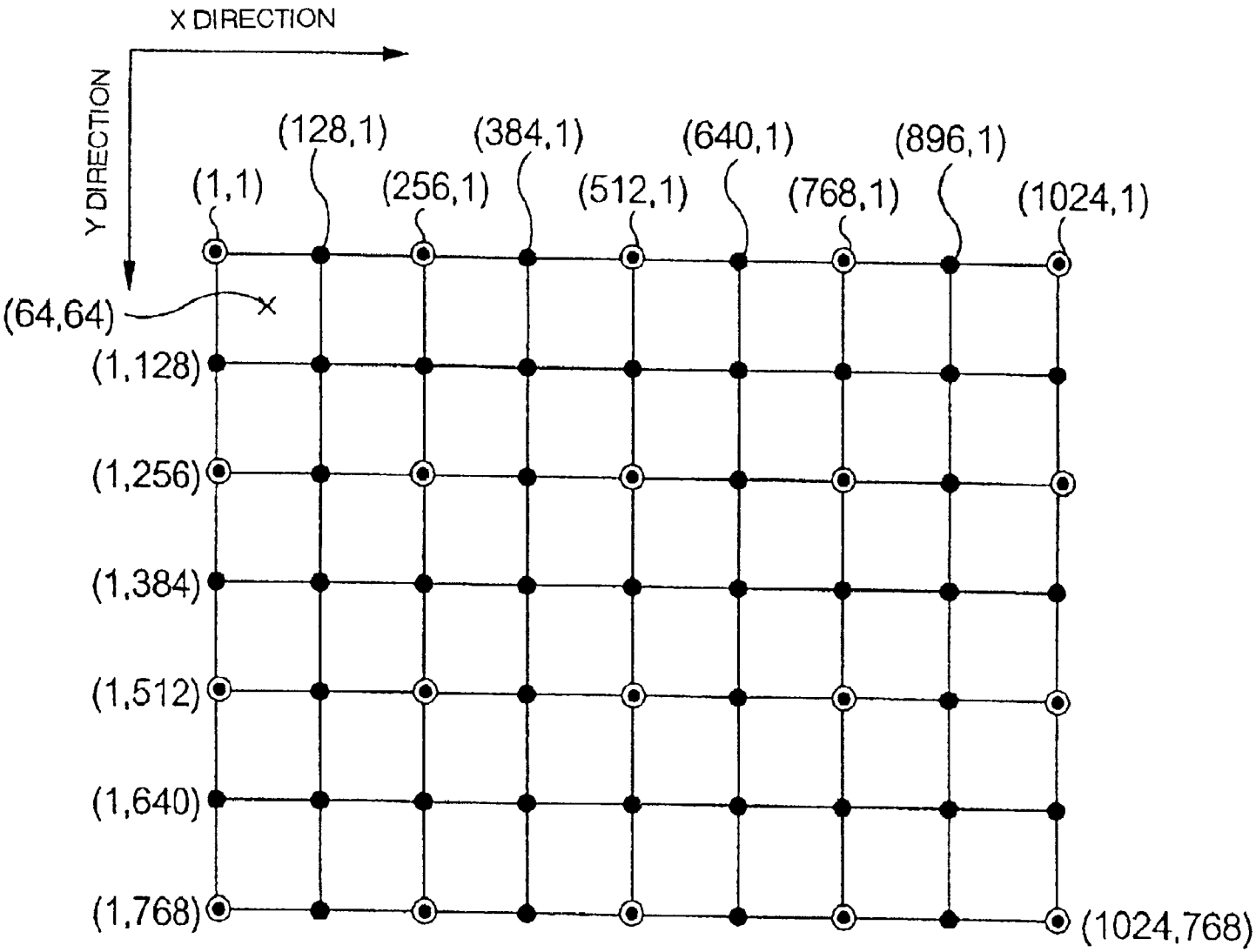
FIG. 15 is a schematic that illustrates the reference coordinates of the second embodiment of the invention.

FIG. 15 is a conceptual diagram showing reference coordinates in the second embodiment in connection with the display region 100*a*. As shown FIG. 15, the display region 100*a* is formed of 1024 dots (row)×768 dots (column), as in the first embodiment. However, the reference coordinates for G differ from those for R and B. Specifically, the display region 100*a* is divided into 8 blocks (row)×6 blocks (column). A total of 63 coordinate points (indicated by black dots and circled dots in FIG. 15) at the apices of these blocks are referred to as reference coordinates for G. Concerning reference coordinates for R and B, only twenty points out of 63 points are used, and the twenty points are indicated by circled dots. Specifically, the reference coordinates for R and B are extracted from the reference coordinates for G based on specific rules.

The reference compensation data Drefr for R and the reference compensation data Drefb for B are stored in association with 20 pairs of reference coordinates, respectively. When this is compared with the reference compensation data Drefg for G stored in association with 63 pairs of reference coordinates, the amount of data for R and B is reduced to 20/63 (approximately ⅓).

The manner in which the reference compensation data Drefr, Drefg, and Drefb are stored in the ROM 12' of the second embodiment is described with reference to FIG. 16. As shown in FIG. 16, concerning G, a trio of reference compensation data "DGwi,j", "DGci,j", and "DGbi,j" is stored in the ROM 12' for each of 63 pairs of reference coordinates. Concerning R, a trio of reference compensation data "DRwi,j", "DRci,j", and "DRbi,j" is stored in the ROM 12' for each of 20 pairs of reference coordinates. Similarly, concerning B, a trio of reference compensation data "DBwi,j", "DBci,j", and "DBbi,j" is stored for each of 20 pairs of reference coordinates.

Accordingly, the reference compensation data Drefr and Drefb are stored at (1,1), (256,1), (512,1), (768,1), and (1024,1) among the reference coordinates (1,1), (128,1), . . . , and (1024,1) in the first row shown in FIG. 16. The reference compensation data Drefr and Drefb are not stored in the second row. From the third row onward, the reference coordinates are similarly reduced as they were in the first and second rows. The storage capacity required in the ROM 12', compared with a case in which data on all the reference coordinates are stored (ROM 12 of the first embodiment), is reduced to (20+63+20)/(63+63+63), i.e., approximately 54%. The storage capacity required in the ROM 12' is substantially reduced.

The manner in which the compensation data DHr, which is generated by interpolating the reference compensation data Drefr, is stored in the compensation table 14R' is described with reference to FIG. 17. As shown in FIG. 17, the compensation data DHr is stored in the compensation table 14R' for each of 20 pairs of reference coordinates. Also, the compensation data DHr is stored corresponding to voltage levels ranging from voltage level V1, which corresponds to the first row, to voltage level V3, which corresponds to an n-th row.

In the first embodiment, concerning R, G, and B, the reference compensation data Drefr, Drefg, and Drefb are stored in association with 63 pairs of reference coordinates. The reference compensation data Drefr, Drefg, and Drefb are interpolated according to the level to generate the compensation data DHr, DHg, and DHb. In contrast, in the second embodiment, concerning R and B, the reference compensation data Drefr and Drefb are stored in association with 20 pairs of reference coordinates. The reference compensation data Drefr and Drefb are interpolated according to the level to generate the compensation data DHr and DHb. Therefore, in the second embodiment, the amount of the compensation data DHr and DHb is reduced to approximately ⅓ compared with that in the first embodiment. It is thus possible to reduce the storage capacities required in the compensation tables 14R' and 14B' to approximately ⅓.

2-2 Operation of Compensation Circuit (Compensation Level Output Unit)

The operation of the compensation level output unit 322' of the second embodiment is specifically described. When the power supply is switched ON, concerning G, the reference compensation data Drefg corresponding to 63 pairs of reference coordinates are read from the ROM 12'. At the same time, concerning R and B, the reference compensation data Drefr and Drefb corresponding to 20 pairs of reference coordinates are read.

Next, the interpolation processor 13 interpolates the reference compensation data Drefr, Drefg, and Drefb according to the level to generate the compensation data DHr, DHg, and DHb. These compensation data DHr, DHg, and DHb are transferred to the compensation tables 14R', 14G, and 14B'.

At the same time, the X counter 10 counts dot clock signals DCLKs, and the Y counter 11 counts horizontal clock signals HCLKs. It is assumed that X-coordinate data Dx and Y-coordinate data Dy, which are the count results, are such that Dx=64 and Dy=64. Specifically, a case in which image data DR', DG', and DB' corresponding to a dot with the coordinates (64,64) in FIG. 15 are compensated is used for explanation.

Four pieces of compensation data DHr1 to DHr4 corresponding to R, which are used as the basis for interpolation according to the coordinates, are read from the compensation table 14R' based on the X-coordinate data Dx, the Y-coordinate data Dy, and the level of the image data. Concerning G, four pieces of compensation data DHgl to DHg4 are read from the compensation table 14G. Similarly, regarding B, four pieces of compensation data DHb1 to DHb4 are read from the compensation table 14B'.

Concerning G, the compensation data corresponding to pairs of reference coordinates (1,1), (128,1), (1,128), and (128,128) are read. Regarding Rand B, the compensation data corresponding to pairs of reference coordinates (1,1), (256,1), (1,256), and (256,256) are read.

Subsequently, the arithmetic units 15R, 15G, and 15B interpolate the four pieces of compensation data, respectively, based on the X-coordinate data Dx and the Y-coordinate data Dy. The interpolation processing is performed using linear interpolation. Therefore, the accuracy is determined in accordance with the distance between the coordinates of the image data to be displayed and the compensation data used to perform interpolation. The shorter the distance is, the more accuracy is obtained. The accuracy of the compensation data Cmp-R and Cmp-B generated by interpolation is lower than that of the compensation data Cmp-G. Since human visual characteristics are such that sensitivity to R and B is lower than to G, the display quality of an image synthesized by combining images in the primary colors RGB is not deteriorated.

In the second embodiment, the reference compensation data Drefr, Drefg, and Drefb have different amounts in accordance with human visual characteristics. Alternatively, the reference compensation data Drefr, Drefg, and Drefb for all pairs of reference coordinates can be prepared, and the number of bits for each piece of data can be set in accordance with the visual characteristics, such that 10 bits are set for Drefg and 5 bits are set for Drefr and Drefb.

3 Third Embodiment

According to the first and second embodiments, the interpolation processor 13 computes the compensation data DHr, DHg, and DHb corresponding to each level ranging from the white reference level (voltage level V1) to the black reference level (voltage level V3), and these compensation data DHr, DHg, and DHb are stored in the compensation tables 14R, 14G, and 14B, respectively. At the same time, in a region below the white reference level V1, the reference compensation data Dref, which corresponds to voltage level V1, is uniformly used. In a region above the black reference level V3, the reference compensation data Dref, which corresponds to voltage level V3, is uniformly used. This is because changes in transmissivity are small in regions below voltage level V1 and above voltage level V3, even when levels of image data differ greatly from each other. It is assumed that interpolation is generally performed in a satisfactory manner by using the reference compensation data Dref corresponding to voltage level V1 or V3.

In fact, when performing display at a luminance level that corresponds to a level below voltage level V1 by uniformly using the reference compensation data Dref, which corresponds to voltage level V1, as compensation data for image data below voltage level V1, interpolation may not be performed in a satisfactory manner since the compensation data Dref does not truly correspond to the image data. A similar situation may arise when performing display at a luminance level above voltage level V3.

According to a third embodiment, appropriate compensation data can be computed in accordance with a voltage level even in regions below voltage level V1 and above voltage level V3. It is thus possible to reduce, minimize or prevent flickering at luminance levels corresponding to regions below voltage level V1 and above voltage level V3.

When compensation data corresponding to a voltage level below voltage level V1 is computed in a region below the voltage level V1, it is assumed that the contents of the compensation data do not differ greatly from those of the reference compensation data Dref corresponding to voltage level V1. In the third embodiment, when the level of image data to be compensated is less than voltage level V1 corresponding to the white reference level, the reference compensation data Dref, which corresponds to voltage level V1, is multiplied by a coefficient in accordance with the difference between the level of the image data and voltage level V1, and the product is used as compensation data which corresponds to that voltage level.

Similarly, when compensation data corresponding to a voltage level above voltage level V3 is computed in a region above the voltage level V3, it is assumed that the contents of the compensation data do not differ greatly from those of the reference compensation data Dref corresponding to voltage level V3. When the level of image data to be compensated exceeds voltage level V3, which corresponds to the black reference level, the reference compensation data Dref corresponding to voltage level V3 is multiplied by a coefficient that gradually increases from "1" as the difference between that the level of the image data and voltage level V3 grows, and the product is used as the compensation data corresponding to that voltage level.

According to the first and second embodiments, when the image data DR' (DG' or DB') is below voltage level V1, the address generator 17R (17G or 17B) generates a column address designating the first column to the compensation table 14R (14G or 14B) and reads the compensation data at four adjacent pairs of reference coordinates, which correspond to voltage level V1. When the image data DR' (DG' or DB') exceeds voltage level V3, the address generator 17R (17G or 17B) generates a column address designating an n-th column and reads compensation data at four adjacent pairs of reference coordinates, which correspond to voltage level V3.

Since this configuration is taken in consideration, according to the third embodiment, the point at which the compensation data corresponding to voltage level V1 or V3 is multiplied by a coefficient lies between the compensation table 14R and the arithmetic unit 15R in FIG. 6. Similarly, the point for G lies between the compensation table 14G and the arithmetic unit 15G; and the point for B lies between the compensation table 14B and the arithmetic unit 15B.

3-1 Configuration of Compensation Circuit (Compensation Level Output Unit)

Figure 18:
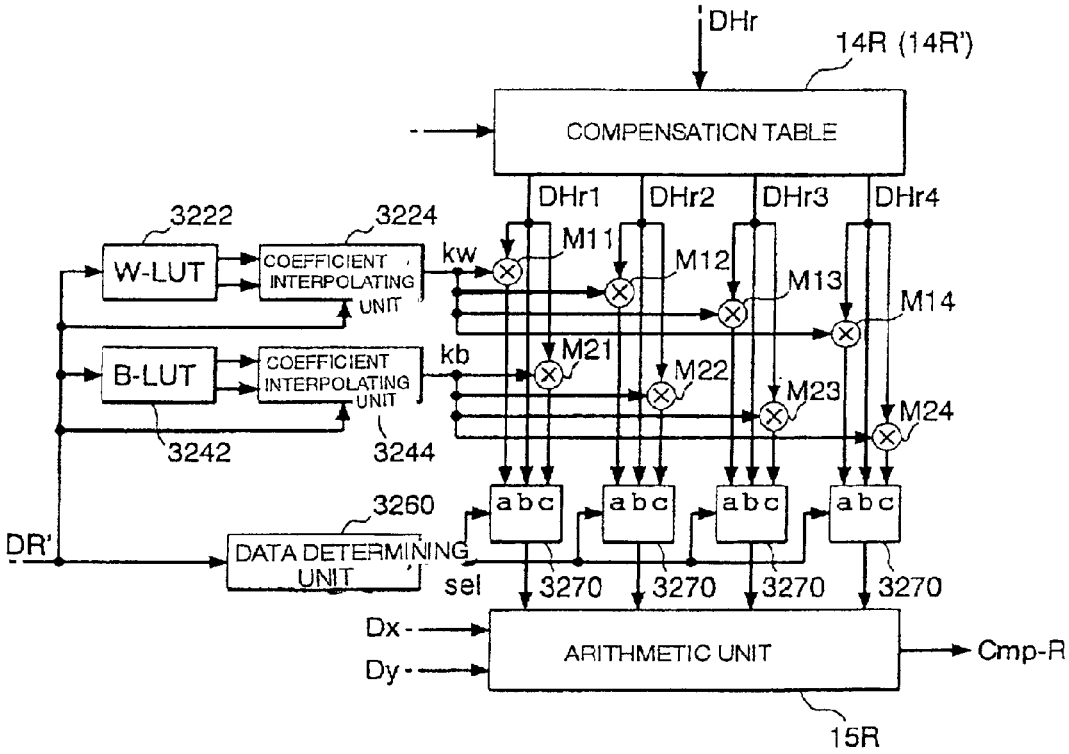
FIG. 18 is a block diagram showing basic parts of a compensation level output unit in a projector according to a third embodiment of the present invention.

The compensation circuit 320 of the third embodiment will now be described. FIG. 18 is a block diagram showing basic portions of the compensation level output unit of the compensation circuit 320 in the third embodiment. These basis portions that are shown in FIG. 18 are added between the compensation table 14R and the arithmetic unit 15R in FIG. 6. Concerning G and B, similar portions are added.

Referring to FIG. 18, when the level of image data DR' to be compensated is below voltage level V1 (white reference level), a W-LUT (look up table) 3222 and a coefficient interpolating unit 3224 output a coefficient kw corresponding to that level.

Figure 19:
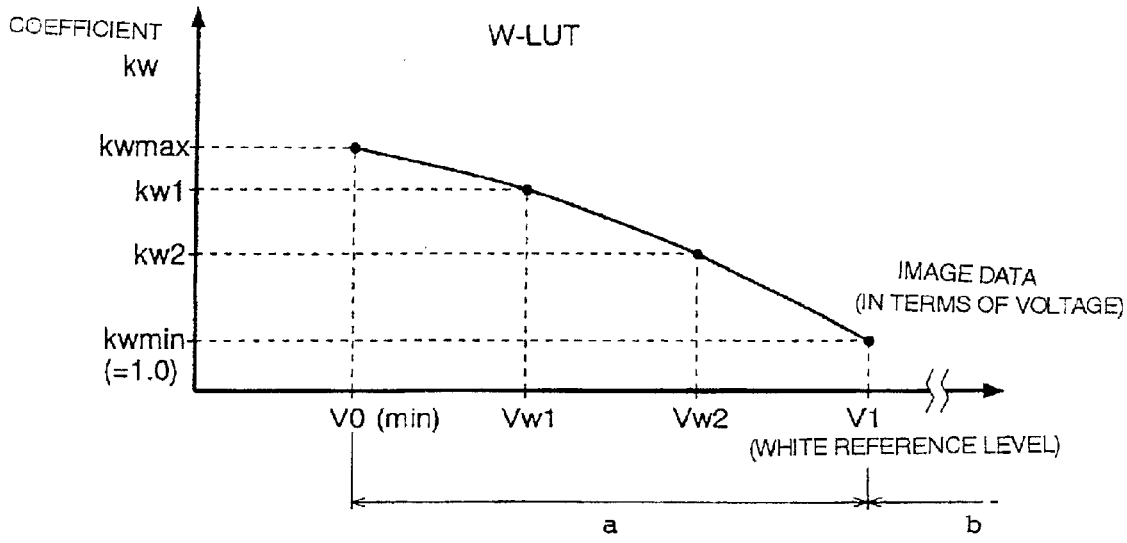
FIG. 19 is a chart that illustrates storage contents of a W-LUT in the configuration.

Specifically, as shown in FIG. 19, the W-LUT 3222 stores coefficient data kwmax, kw1, kw2, and kwmin lying on a characteristic curve gradually changing from "1" as the level decreases from the white reference level V1. The coefficient data kwmax, kw1, kw2, and kwmin correspond to four voltage levels V0, Vw1, Vw2, and V1, respectively. At the same time, when the image data DR' at a level above the minimum voltage level V0 and below voltage level V1 (white reference level) is input, the W-LUT 3222 outputs two pieces of coefficient data at levels higher and lower than that level. For example, when the level of the image data DR' is above voltage level Vw1 and below voltage level Vw2, the W-LUT 3222 outputs two pieces of coefficient data, i.e., the coefficient data kw1 corresponding to voltage level Vw1 and the coefficient data kw2 corresponding to voltage level Vw2.

The coefficient interpolating unit 3224 interpolates the two pieces of coefficient data output from the W-LUT 3222, and supplies the coefficient data kw corresponding to the level of the image data DR', which is below voltage level V1, to one input port of each of multipliers M11 to M14.

Similarly, when the level of the image data DR' exceeds voltage level V3 (black reference level), a B-LUT 3242 and a coefficient interpolating unit 3244 output a coefficient kb corresponding to that level.

Figure 20:
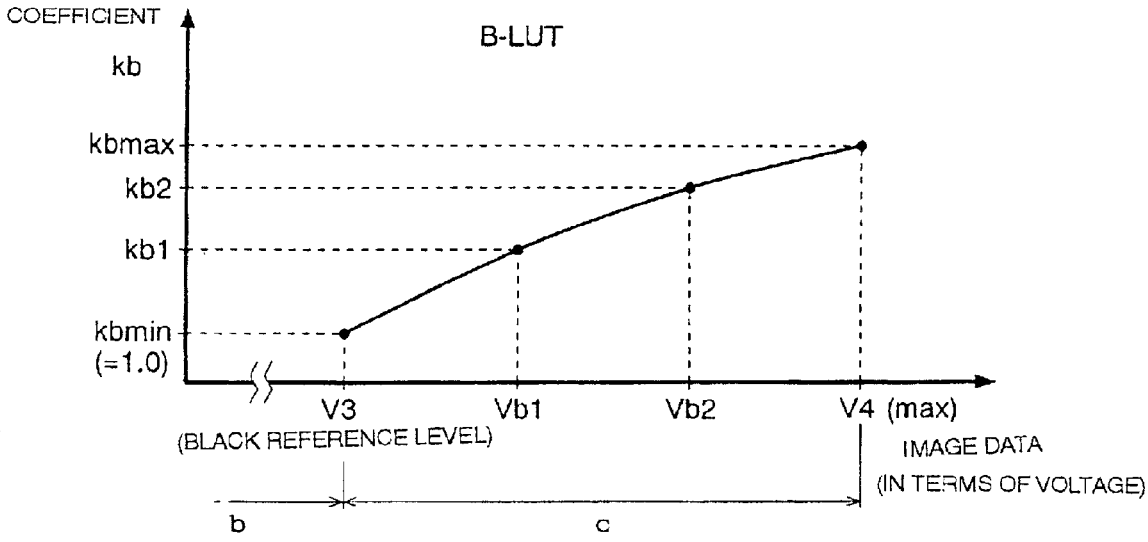
FIG. 20 is a chart that illustrates storage contents of a B-LUT in the configuration.

Specifically, as shown in FIG. 20, the B-LUT 3242 stores coefficient data kbmin, kb1, kb2, and kbmax lying on a characteristic curve gradually increasing form "1" as the level increases from the black reference level V3. The coefficient data kbmin, kb1, kb2, and kbmax correspond to four voltage levels V3, Vb1, Vb2, and V4, respectively. At the same time, when the image data DR' at a level above voltage level V3 (black reference level) and below the maximum voltage level V4 is input, two pieces of coefficient data at levels higher and lower than that level are output. For example, when the level is above voltage level Vb2 and below voltage level V4, the B-LUT 3242 outputs two pieces of coefficient data, i.e., the coefficient data kb2 corresponding to voltage level Vb2 and the coefficient data kbmax corresponding to voltage level V4.

The coefficient interpolating unit 3244 interpolates the two pieces of coefficient data output from the B-LUT 3242, and supplies the coefficient data kb corresponding to the level of the image data DR', which exceeds voltage level V3, to one input port of each of multipliers M21 to M24. In the third embodiment, the coefficient characteristics of the W-LUT 3222 and the B-LUT 3242 are set while the display characteristics shown in FIG. 8 are taken into consideration. The actual coefficient characteristics may differ from those shown in FIGS. 19 and 20.

In the third embodiment, among the four pieces of compensation data read from the compensation table 14R, compensation data DHr1 is divided into three pieces, and the pieces of compensation data DHr1 are output via three paths. Specifically, the compensation data DHr1 is supplied to the other input port of the multiplier M11 as a first path; the compensation data DHr1 is supplied to an input port b of a selector 3270 as a second path. The compensation data DHr1 is supplied to the other input port of the multiplier M21 as a third path. Similarly, the remaining three pieces of compensation data DHr2, DHr3, and DHr4 are input to the other input port of each of the multipliers M12, M13, and M14, respectively, as a first path. The compensation data DHr2, DHr3, and DHr4 are input to the input ports b of the respective selectors 3270 as a second path. The compensation data DHr2, DHr3, and DHr4 are input to the other input port of each of the multipliers M22, M23, and M24, respectively, as a third path. The products computed by the multipliers M11 to M14 are input to input ports a of the respective selectors 3270, and the products computed by the multipliers M21 to M24 are input to input ports c of the respective selectors 3270.

Subsequently, the four selectors 3270 select and output one of the input ports a, b, and c in accordance with a control signal sel. A data determining unit 3260 determines the level of the image data DR' and outputs the following control signals sels to the four selectors 3270. Specifically, when the level of the image data DR' is below voltage level V1, the data determining unit 3260 outputs a control signal sel that causes the selectors 3270 to select the input ports a. When the level of the image data DR' is above voltage level 1 and below voltage level V3, the data determining unit 3260 outputs a control signal sel that causes the selectors 3270 to select the input ports b. When the image data DR' exceeds voltage level V3, the data determining unit 3260 outputs a control signal sel that causes the selectors 3270 to select the input ports c. The arithmetic unit 15R computes compensation data Cmp-R that will correspond to the coordinates (coordinates corresponding to the image data DR') specified by the X-coordinate data Dx and the Y-coordinate data Dy by performing interpolation processing based on the compensation data selected and output by the four selectors 3270. This operation is similar to the first and second embodiments.

Specifically, when the level of the image data DR' is below voltage level V1, the arithmetic unit 15R in the third embodiment interpolates the products by the multipliers M11 to M14 with respect to the coordinates. When the level of the image data DR' exceeds voltage level V3, the arithmetic unit 15R interpolates the products by the multipliers M21 to M24 with respect to the coordinates.

3-2 Operation of Compensation Circuit

The operation of the compensation circuit 320 in the third embodiment is specifically described by using R for explanation. The operation up to the reading of four pieces of compensation data DHr1 to DHr4, which are used as the basis for interpolation according to the coordinates, from the compensation table 14R based on the X-coordinate data Dx, the Y-coordinate data Dy, and the data value of the image data DR' (step S5 in FIG. 12) is the same as that in the first embodiment.

The operation from the point at which the compensation data Cmp-R, which will correspond to the coordinates specified by the X-coordinate data and the Y-coordinate data Dy, is interpolated by the arithmetic unit 15R based on the four pieces of compensation data onward is the same as that in the first embodiment.

The following description mainly illustrates the operation up to the supplying of four pieces of compensation data DHr1 to DHr4 read from the compensation table 14R to the arithmetic unit 15R. The description is divided into the following cases.

3-2-1 When Level of Image Data is Below V1

The operation when the level of the supplied image data DR' is below voltage level V1 corresponding to the white reference level is described. In this case, the W-LUT 3222 outputs two pieces of coefficient data at levels higher and lower than the level of the image data DR'. The coefficient interpolating unit 3224 interpolates the two pieces of coefficient data, and outputs coefficient data kw corresponding to the level of the image data DR'.

In contrast, when the level of the supplied image data DR' is below voltage level V1, four pieces of compensation data DHr1 to DHr4, which are output from the compensation table 14R, correspond to four pairs of reference coordinates surrounding the coordinates specified by the X-coordinate data Dx and the Y-coordinate data Dy. The four pairs of reference coordinates correspond to the white reference level.

Therefore, the products computed by the multipliers M11 to M14 appropriately reflect compensation data which corresponds to four pairs of reference coordinates and which corresponds to voltage level V1 in accordance with the difference between the level of the image data DR' and voltage level V1, which is the white reference level. At the four selectors 3270, the input ports a are selected by the data determining unit 3260. The arithmetic unit 15R interpolates the four products computed by the multipliers M11 to M14 according to the coordinates, thus computing the compensation data Cmp-R which corresponds to the image data DR'.

The operation for computing the compensation data Cmp-R corresponding to the image data DR' for R is described. A similar description also applies to the operation for computing compensation data Cmp-G, which corresponds to the image data DG' for G and compensation data Cmp-B, which corresponds to the image data DB' for B.

3-2-2 When Level of Image Data is Above V1 and Below V3

The operation when the level of the supplied image data DR' is above voltage level V1, which corresponds to the white reference level, and below voltage level V3, which corresponds to the black reference level, is described.

In this case, as described above, four pieces of compensation data DHr1 to DHr4, which are output from the compensation table 14R, correspond to four pairs of the reference coordinates surrounding the coordinates specified by the X-coordinate data Dx and the Y-coordinate data Dy. At the four pairs of reference coordinates, the compensation data DHr1 to DHr4 correspond to the level of the image data. On the other hand, at the four selectors 3270, the input ports b are selected by the data determining unit 3260. The arithmetic unit 15R interpolates the four pieces of compensation data DHr1 to DHr4 read from the compensation table 14R according to the coordinates, thereby computing the compensation data Cmp-R which corresponds to the image data DR'.

In other words, this computing operation is the same as that in the first embodiment. As in the first embodiment, flickering can be reduced, minimized or prevented by the operation when the level of the image data DR' is above voltage level V1, which corresponds to the white reference level, and below voltage level V3, which corresponds to the black reference level.

3-2-3 When Level of Image Data Exceeds V3

The operation when the level of the supplied image data DR' exceeds voltage level V3, which corresponds to the black reference level, is described. In this case, the B-LUT 3242 outputs two pieces of coefficient data at levels higher and lower than the level of the image data DR'. The coefficient interpolating unit 3244 interpolates the two pieces of coefficient data and outputs coefficient data kb corresponding to the level of the image data DR'.

At the same time, when the level of the supplied image data DR' exceeds voltage level V3, as described above, four pieces of compensation data DHr1 to DHr4, which are output from the compensation table 14R, correspond to four pairs of the reference coordinates surrounding the coordinates specified by the X-coordinate data Dx and the Y-coordinate data Dy. At the four pairs of reference coordinates, the compensation data DHr1 to DHr4 correspond to the black reference level.

The products computed by the multipliers M21 to M24 are computed by appropriately expanding the compensation data corresponding to the four pairs of reference coordinates, each pair corresponding to voltage level V3, in accordance with the difference between the level of the image data DR' and voltage level V3, which is the black reference level. At the four selectors 3270, the input ports c are selected by the data determining unit 3260. The arithmetic unit 15R interpolates the four products computed by the multipliers M21 to M24 with respect to the coordinates, thereby computing the compensation data CmpR which corresponds to the image data DR'.

The operation for computing the compensation data Cmp-R corresponding to the image data DR' for R is described. Similar description applies to the computing of compensation data Cmp-G, which corresponds to the image data DG' for G, and compensation data Cmp-B, which corresponds to the image data DB' for B.

According to the third embodiment, when the level of the image data DR' is below voltage V1, compensation data corresponding to the white reference level is multiplied by a coefficient corresponding to the level of the image data. When the level of the image data DR' exceeds voltage V3, compensation data corresponding to the black reference level is multiplied by a coefficient corresponding to the level of the supplied image data. Accordingly, the compensation data corresponding to the level of the supplied image data is computed. By performing interpolation processing according to the coordinates, the compensation data Cmp-R is computed. Therefore, it is possible to appropriately remove flickering at levels corresponding to regions below voltage level V1 and above voltage level V3.

According to the third embodiment, a case in which the compensation level output unit 322 (see FIG. 6) of the first embodiment is used has been described. Alternatively, it is possible to use the compensation level output unit 322' (see FIG. 14) of the second embodiment.

According to the third embodiment, the W-LUT 3222 is provided corresponding to a region below voltage level V1, and the B-LUT 3242 is provided corresponding to a region above voltage level V3. Alternatively, it is possible to use a common look up table. Alternatively, it is possible to use a look up table only in one of regions below voltage level V1 and above voltage level V3 in order to compute compensation data.

According to the third embodiment, the W-LUT 3222 and the B-LUT 3242 are configured to store four pieces of coefficient data at different voltage levels. In order to enhance the accuracy, it is possible to store five or more pieces of coefficient data. In order to reduce the storage capacity, it is possible to store three or two pieces of coefficient data.

4 Modifications

In the foregoing embodiments, interpolation with respect to the level or coordinates can be implemented by various interpolation methods, such as linear interpolation, extrapolation, and n-degree interpolation.

Besides the foregoing method for determining the reference compensation data to be stored in the ROM 12, various other methods can be used. For example, reference compensation data Dref, which corresponds to the center (gray) level of a particular color, and which corresponds to a particular pair of reference coordinates, can be set in the following manner.

First, no compensation data is added to the image data, which corresponds to the center level of the color, and which corresponds to the pair of reference coordinates, and positive polarity writing and negative polarity writing are alternately executed. Second, the potential LCcom of the counter electrode 108 is adjusted so that flickering at the pair of reference coordinates is reduced, minimized or prevented (see FIG. 13(*c*)). Third, based on a variation ΔV caused by the adjustment, the reference compensation data is determined.

Alternatively, first, concerning a pixel corresponding to a certain pair of reference coordinates, the potential LCcom of the counter electrode 108 is maintained at a constant potential. After the polarity inversion, the potential of an image signal in positive polarity writing and the potential of an image signal in negative polarity writing are shifted in the opposite directions so that they have the same displacement, and a point at which the least amount of flickering is generated is determined. Second, based on the displacement up to this point, the reference compensation data, which corresponds to the pair of reference coordinates, is determined.

In the embodiments, the compensation data Cmp-R, Cmp-G, and Cmp-B are added to the image data DR', DG', and DB', which correspond to positive polarity writing, whereas the image data which corresponds to negative polarity writing is not compensated. Conversely, the compensation data can be added to the image data DR', DG', and DB', which correspond to negative polarity writing, while the image data which correspond to positive polarity writing is not compensated.

Figure 21:
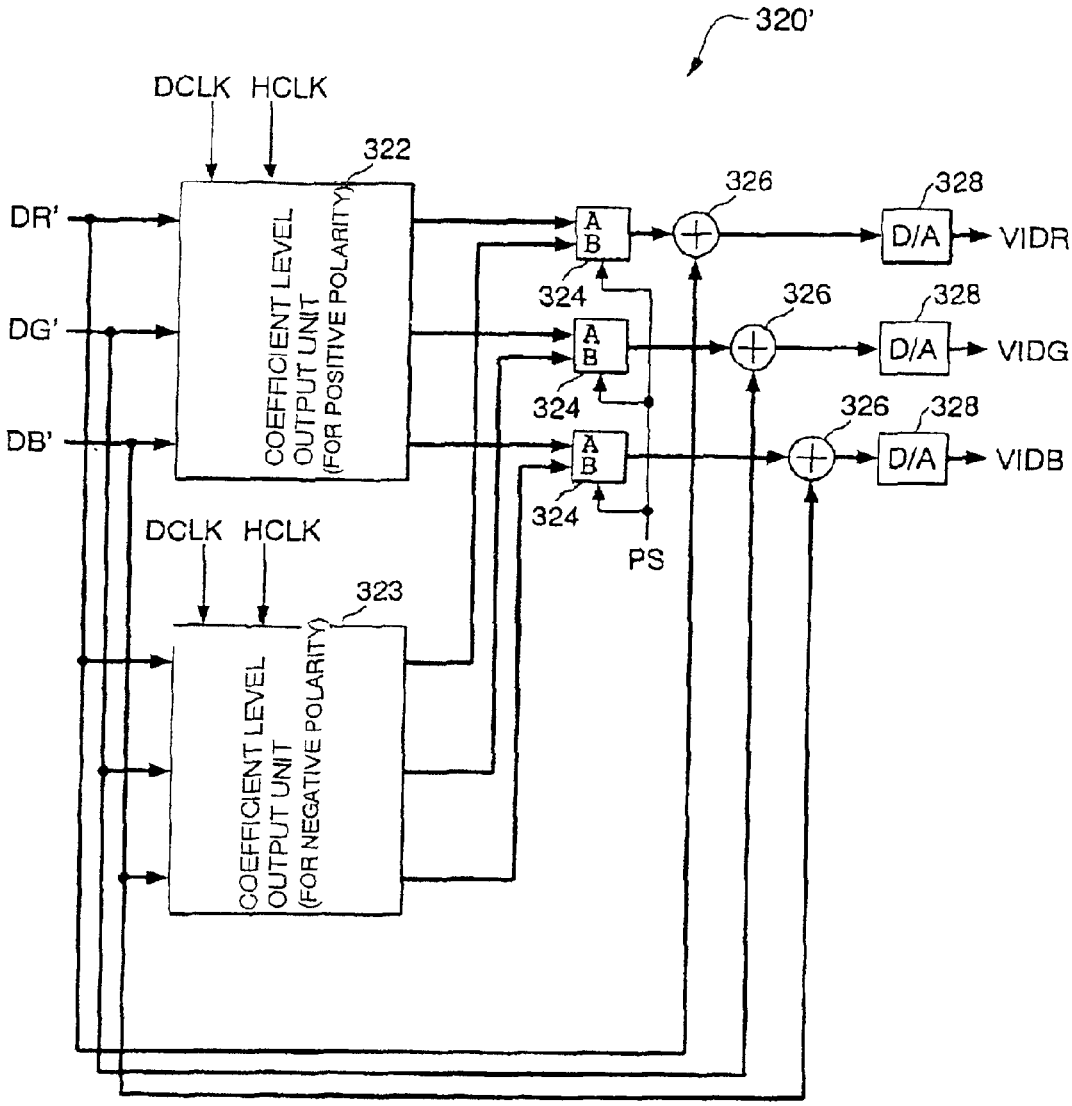
FIG. 21 is a block diagram showing a modification of the compensation circuit according to the embodiments of the invention.

Alternatively, as shown in FIG. 21, it is possible to add the compensation data to the image data corresponding to positive polarity writing and to the image data corresponding to negative polarity writing. With this arrangement, in positive polarity writing, compensation data generated by a positive-polarity compensation level output unit 322 is selected by the selectors 324. In negative polarity writing, compensation data generated by a negative-polarity compensation level output unit 323 is selected by the selectors 324. The selected compensation data is added to the original image data by the individual adders 324. With the arrangement, two compensation level output units 323 and 324 are necessary, which makes it inappropriate for reducing the circuit size.

Although the processing time starting from the compensation level output unit 322 to the adders 326 is ideally zero in FIG. 5, it actually takes some time. Thus, a delay unit is provided to match the output timing of the compensation data Cmp-R, Cmp-G, and Cmp-B prior to inputting the uncompensated image data DR', DG', and DB' to the corresponding adders 326. The same applies to the configuration shown in FIG. 21.

In the foregoing embodiments, six data lines 114 are grouped into one block, and the image signals VID1 to VID6, which are obtained by converting a one-system signal into six systems, are sampled with respect to the six data lines 114 which belong to one block. The conversion number and the number of data lines to which the signals are simultaneously applied (that is, the number of data lines forming one block) are not limited to "6". For example, if the response speed of the sampling switch 151 is sufficiently high, the image signal is not necessarily subjected to parallel conversion. Instead, the image signal is serially transmitted to one image signal line and is sequentially sampled with respect to each data line 114.

Alternatively, the conversion number and the number of data lines to which the image signals are simultaneously supplied can be "3", "12", or "24", and the image signal, which is converted to three systems, twelve systems, or 24 systems, can be supplied to three data lines, twelve data lines, or 24 data lines. Concerning the conversion number, since a color image signal is formed of a signal for the three primary colors, it is preferable that the conversion number be a multiple of three with a view to simplifying the control and circuitry. If the present invention is simply used to modulate light, as in a projector (described above), the conversion number is not necessarily a multiple of three.

In the foregoing embodiments, compensation is performed by the compensation circuit 320 prior to serial-parallel conversion of the image signal. Alternatively, compensation can be performed subsequent to serial-parallel conversion. Alternatively, serial-parallel conversion does not need to necessarily be performed.

In the foregoing embodiments, the liquid crystal display operates in a normally white mode in which white is displayed when the effective voltage applied to the liquid crystal capacitor is zero. Alternatively, the liquid crystal display can operate in a normally black mode in which black is displayed when the effective voltage applied to the liquid crystal capacitor is zero.

In the foregoing embodiments, the TFTs 116 are used as the switching devices in the pixel electrodes 118. A silicon substrate can be used as the substrate, and various devices can be formed on the silicon substrate. In such cases, electric field effect transistors can be used as various switches, and hence the high-speed operation can be facilitated. If the device substrate 101 is not transparent, the liquid crystal display must be used as a reflective type by forming the pixel electrodes 118 from aluminum or by forming an additional reflecting layer.

Although the TN-type liquid crystal is used in the foregoing embodiments, a BTN (Bi-stable Twisted Nematic) type or a ferroelectric type having memory effects, a macromolecular dispersed type, or a GH (guest-host) type can be used instead. In the GH type, a dye (guest), which exhibits anisotropy in visible light absorption between the long axis direction and the short axis direction of the molecules, is dissolved in a liquid crystal (host) whose molecules are aligned in a certain direction, with the dye molecules being oriented parallel to the liquid crystal molecules.

Alternatively, a homeotropic alignment structure can be used. In the homeotropic alignment structure, with no voltage applied, the liquid crystal molecules are oriented perpendicular to both substrates, and, when a voltage is applied, the liquid crystal molecules are oriented horizontal to both substrates. Also, a homogeneous alignment structure can be used instead. In the homogeneous alignment structure, with no voltage applied, the liquid crystal molecules are oriented horizontal to both substrates, and, when a voltage is applied, the liquid crystal molecules are oriented perpendicular to both substrates. According to the present invention, various types of liquid crystal and alignment modes can be used.

5 Electronic Apparatus

Examples of using the above-described processing circuit in an electronic apparatus other than a projector are described below.

5-1 Mobile Computer

Figure 22:
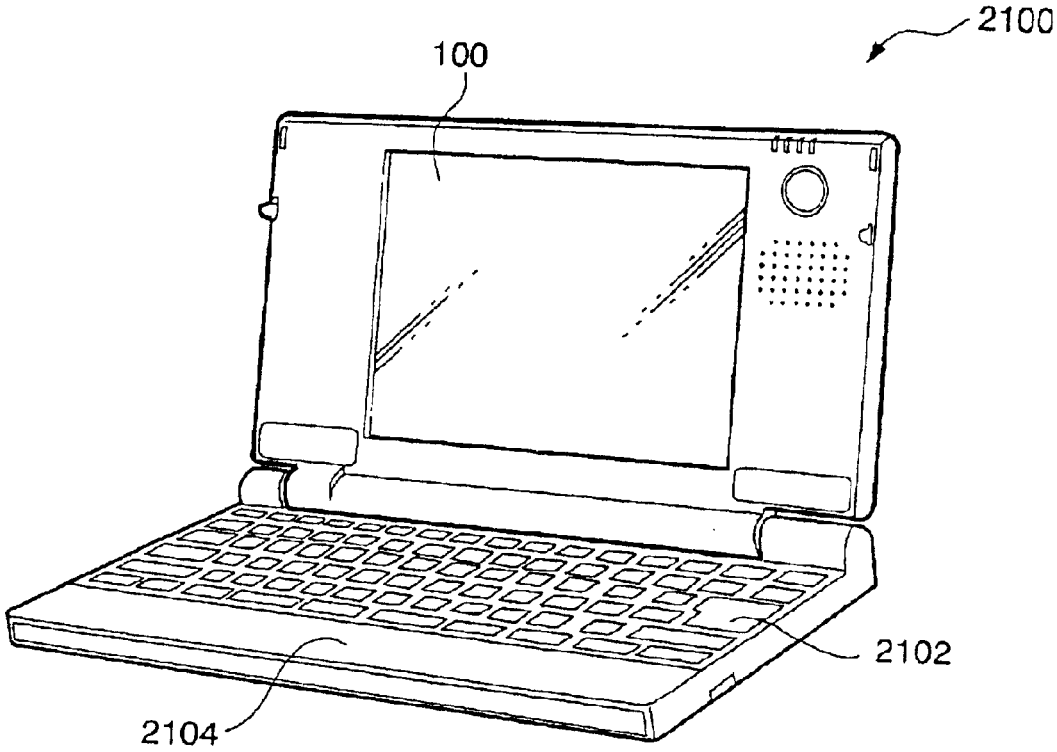
FIG. 22 is a perspective view of the configuration of a personal computer, which is an example of an electronic apparatus in which the compensation circuit is used.

An example of using the above-described processing circuit in a display unit of a mobile computer is described. FIG. 22 is a perspective view of the configuration of the computer. In FIG. 22, a computer 2100 includes a main unit 2104 provided with a keyboard 2102 and the liquid crystal panel 100. A backlight unit (not shown) that enhances the visibility is provided at the back of the liquid crystal panel 100.

The above-described projector 1100 includes three panels, namely, the liquid crystal panels 100R, 100G, and 100B, corresponding to the respective RGB colors. In contrast, the single liquid crystal panel 100 used in the computer 2100 can display the RGB colors using a color filter. Image signals VIDr1 to VIDr6, VIDg1 to VIDg6, and VIDb1 to VIDb6 are not supplied in parallel to the liquid crystal panel 100, and instead are supplied using time-sharing. In this case, as in the compensation circuit 320, two-step interpolation is performed according to the level and the coordinates, thereby substantially reducing, minimizing or preventing flickering in the entire display region.

5-2 Cellular Phone

Figure 23:
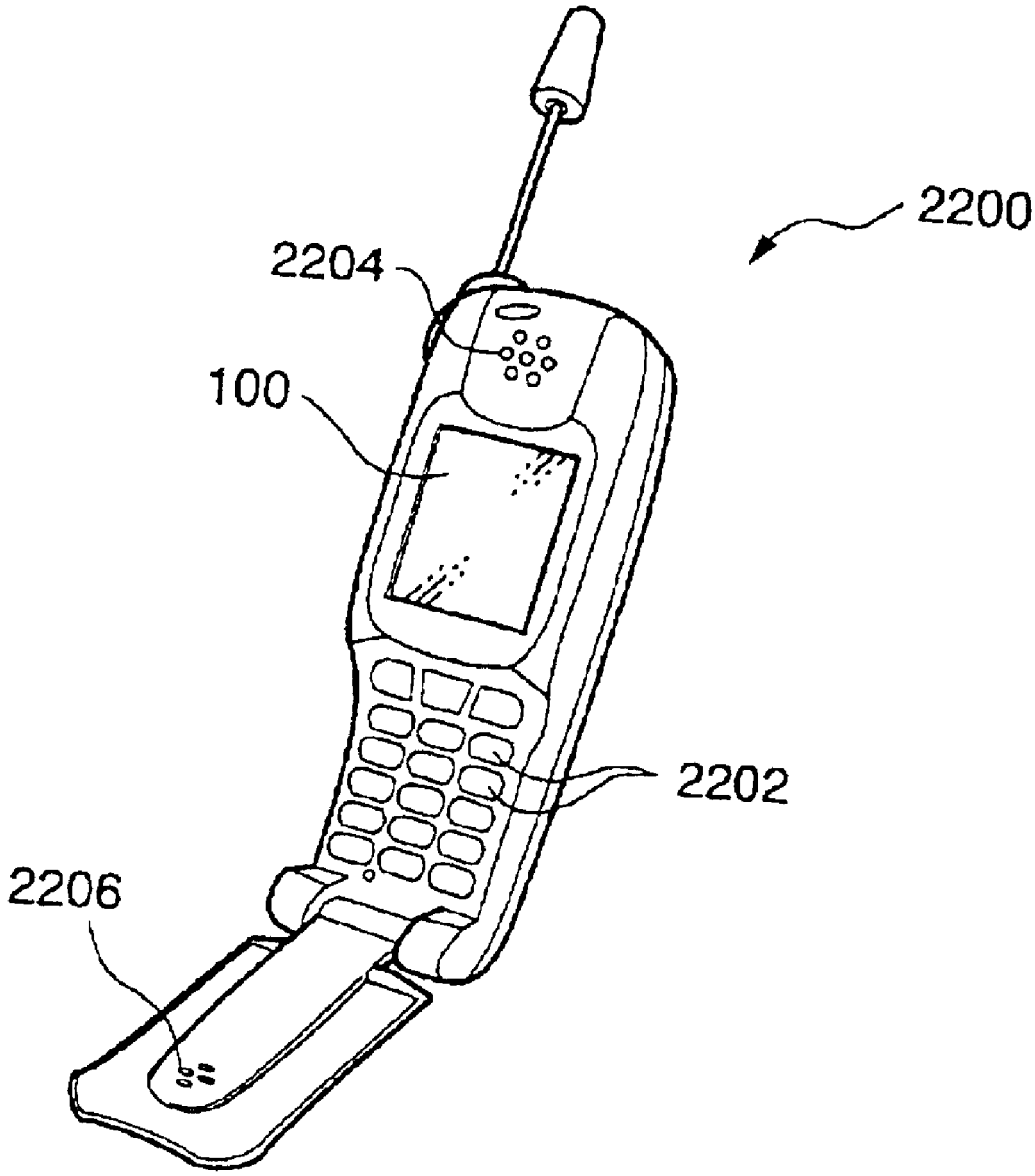
FIG. 23 is a perspective view of the configuration of a cellular phone, which is another example of an electronic apparatus in which the compensation circuit is used.

An example of using the above-described processing circuit in a display unit of a cellular phone is described below. FIG. 23 is a perspective view of the configuration of the cellular phone. In the drawing, a cellular phone 2200 includes a plurality of operating buttons 2202, an earpiece receiver 2204, a mouthpiece transmitter 2206, and the liquid crystal panel 100 used as the display unit. The single liquid crystal panel 100 can display the RGB colors using a color filter. Alternatively, the display unit may perform monochrome display. When the display unit is to perform monochrome display, the image processing circuit only requires such a configuration as to perform display in a single color instead of performing display in the three primary colors.

6 Others

In addition to the electronic apparatuses illustrated in FIGS. 22 and 23, other types of apparatuses can be used, such as, for example, a liquid crystal television, a viewfinder videocassette recorder, a monitor-direct-view videocassette recorder, a car navigation apparatus, a pager, an electronic notebook, a calculator, a word processor, a workstation, a television phone, a POS terminal, and an apparatus provided with a touch panel. Needless to say, the present invention is applicable to these and other electronic apparatuses.

As described above, according to the present invention, two-step interpolation is performed according to the level and to the coordinates, thus minimizing flickering to a great extent while requiring a small memory capacity.

What is claimed is:

1. An image data compensation method to convert image data, indicating gray levels of pixels aligned in a matrix in an X direction and a Y direction, into analog data and to compensate the image data when a voltage signal is supplied to each of the pixels, a polarity of the voltage signal being inverted based on a predetermined constant potential every predetermined period, comprising the steps of:

storing reference compensation data corresponding to specific levels among levels available to the image data for each pair of reference coordinates preset in a display region in which the pixels are aligned;

interpolating the stored reference compensation data in the level directions to generate first compensation data corresponding to the levels available to the image data for the each pair of reference coordinates and storing the first compensation data in association with the each pair of reference coordinates and the levels;

selectively reading, from the stored first compensation data, pieces of data which correspond to pairs of reference coordinates positioned near the coordinates of the pixel corresponding to the image data and which correspond to the level of the image data;

interpolating the read first compensation data in the coordinate directions to generate second compensation data which corresponds to the image data; and adding the second compensation data to the image data in a case in which the voltage signal is positive, the second compensation data being performed for a case in which the voltage signal is positive with respect to the constant potential, whereby the image data is compensated.

2. An image data compensation circuit that converts image data, indicating gray levels of pixels aligned in a matrix in an X direction and a Y direction, into analog data and that compensates the image data when a voltage signal is supplied to each of the pixels, a polarity of the voltage signal being inverted based on a predetermined constant potential every predetermined period, comprising:

a memory that stores reference compensation data corresponding to specific levels among levels available to the image data for each pair of reference coordinates preset in a display region in which the pixels are aligned;

an interpolation processor that interpolates the reference compensation data stored in the memory in the level directions to generate first compensation data corresponding to the levels available to the image data for the each pair of reference coordinates;

a compensation table that stores the first compensation data in association with the reference coordinates and the levels;

a reading unit that reads selectively, from the first compensation data stored in the compensation table, pieces of data which correspond to pairs of reference coordinates positioned near the coordinates of the pixel corresponding to the image data and which correspond to the level of the image data;

an arithmetic unit that interpolates the read first compensation data in the coordinate directions to generate second compensation data corresponding to the image data; and an adder that adds the second compensation data to the image data in a case in which the voltage signal is positive, the second compensation data being performed for a case in which the voltage signal is positive with respect to the constant potential, whereby the image data is compensated.

3. The image data compensation circuit according to claim 2, the adder adding the second compensation data to the image data in only one of the case in which the voltage signal is positive and the case in which the voltage signal is negative; and in the other one of the case in which the voltage signal is positive and the case in which the voltage signal is negative, the adder adding a substantially zero value to the image data.

4. The image data compensation circuit according to claim 3, the reference compensation data corresponding to the specific level being a value adjusted so as to reduce the difference in the gray level between the one case in which the sum of the reference compensation data and the image data corresponding to the specific level is applied to a pixel electrode and the other case in which the reference compensation data is not added to the image data corresponding to the specific level and the image data is applied to the pixel electrode.

5. The image data compensation circuit according to claim 2, the reading unit including:

an X counter that counts first clock signals which are used as a time reference for X-direction scanning in the display region and that generates X-coordinate data indicating the X coordinate of the pixel corresponding to the image data in the display region;

a Y counter that counts second clock signals which are used as a time reference for Y-direction scanning in the display region and for generating Y-coordinate data indicating the Y coordinate of the pixel corresponding to the image data in the display region; and an address generator that specifies a plurality of pairs of reference coordinates positioned near the coordinates of the pixel corresponding to the image data based on the X-coordinate data and the Y-coordinate data and that generates addresses to read the corresponding first compensation data from the compensation table based on the specified pairs of reference coordinates and the level of the image data, the arithmetic unit performing interpolation in accordance with the distance from the coordinates of the image data specified by the X-coordinate data and the Y-coordinate data to each of the specified pairs of reference coordinates corresponding to the read first compensation data.

6. The image data compensation circuit according to claim 5, the memory, the interpolation processor, the X counter, and the Y counter being shared among RGB colors, and the compensation table, the arithmetic unit, the address generator, and the adder being provided in association with each of the RGB colors.

7. The image data compensation circuit according to claim 2, the pixel including a liquid crystal capacitor formed of two electrodes and liquid crystal provided therebetween, and the specific levels to which the reference compensation data correspond including first and second levels corresponding to first and second points at which a display characteristic curve indicating at least one of transmissivity and reflectivity with respect to the effective value of a voltage applied to the liquid crystal capacitor suddenly changes and at least one level between the first and second levels.

8. An image data compensation circuit that converts image data, indicating gray levels of pixels aligned in a matrix in an X direction and a Y direction, into analog data and that compensates the image data when a voltage signal is supplied to each of the pixels, a polarity of the voltage signal being inverted based on a predetermined constant potential every predetermined period, comprising:

a memory that stores reference compensation data corresponding to specific levels among levels available to the image data for each pair of reference coordinates preset in a display region in which the pixels are aligned;

an interpolation processor that interpolates the reference compensation data stored in the memory in the level directions to generate first compensation data corresponding to the levels available to the image data for the each pair of reference coordinates;

a compensation table that stores the first compensation data in association with the reference coordinates and the levels;

a reading unit that reads selectively, from the first compensation data stored in the compensation table, pieces of data which correspond to pairs of reference coordinates positioned near the coordinates of the pixel corresponding to the image data and which correspond to the level of the image data;

an arithmetic unit that interpolates the read first compensation data in the coordinate directions to generate second compensation data corresponding to the image data;

an adder that adds the second compensation data to the image data in at least one of a case in which the voltage signal is positive and a case in which the voltage signal is negative with respect to the constant potential, whereby the image data is compensated;

the pixel including a liquid crystal capacitor formed of two electrodes and liquid crystal provided therebetween;

the specific levels to which the reference compensation data correspond including first and second levels corresponding to first and second points at which a display characteristic curve indicating at least one of transmissivity and reflectivity with respect to the effective value of a voltage applied to the liquid crystal capacitor suddenly changes and at least one level between the first and second levels, the interpolation processor operating so as to:

interpolate the reference compensation data to generate the first compensation data corresponding to levels ranging from the first level to the second level, use the reference compensation data corresponding to the first level for the first compensation data corresponding to levels below the first level, and use the reference compensation data corresponding to the second level for the first compensation data corresponding to levels exceeding the second level;

the compensation table operating so as to:

store the first compensation data for levels ranging from the first level to the second level; and the reading unit operating so as to:

select data corresponding to the first level from the first compensation data stored in the compensation table when the level of the image data is below the first level, select data which is generated in accordance with the level of the image data when the level of the image data is within a range between the first level and the second level, and select data corresponding to the second level when the level of the image data exceeds the second level.

9. The image data compensation circuit according to claim 8, further comprising:

a coefficient output unit that outputs a coefficient in accordance with the difference between the level of the image data and the first or second level when the level of the image data is below the first level or exceeds the second level; and a multiplier that multiplies the read first compensation data corresponding to the first or second level by the coefficient output from the coefficient output unit, the arithmetic unit performing interpolation according to the coordinates by using the product obtained by the multiplier as the first compensation data which is selectively read by the reading unit.

10. The image data compensation circuit according to claim 9, the coefficient output unit including:

a look up table that stores coefficients corresponding to at least two levels in a region in which the level of the image data is below the first level or in a region in which the level of the image data exceeds the second level; and a coefficient interpolating unit that interpolates the coefficients stored in the look up table and computing a coefficient corresponding to the image data.

11. The image data compensation circuit according to claim 5, the image data and the reference compensation data corresponding to each of the RGB colors, the interpolation processor generating the first compensation data in association with each of the RGB colors, and the compensation table, the arithmetic unit, and the adder being provided in association with each of the RGB colors.

12. The image data compensation circuit according to claim 11, the memory storing a greater amount of reference compensation data for G than for R or for B.

13. The image data compensation circuit according to claim 12, the reference coordinates for R or B being extracted from the reference coordinates for G.

14. An image data compensation circuit that converts image data, indicating gray levels of pixels aligned in a matrix in an X direction and a Y direction, into analog data and that compensates the image data when a voltage signal is supplied to each of the pixels, a polarity of the voltage signal being inverted based on a predetermined constant potential every predetermined period, comprising:

a memory that stores white reference compensation data which corresponds to a white reference level, black reference compensation data which corresponds to a black reference level, and at least one piece of intermediate reference compensation data which corresponds to a level between the white reference level and the black reference level;

a first compensation data generator that interpolates the pieces of reference compensation data in the memory in the level directions based on half tone image data of the image data in one polarity and for generating first compensation data;

a second compensation data generator that interpolates coordinate data for the half tone image data and the first compensation data in the coordinate directions and for generating second compensation data; and an adder that adds the second compensation data to the half tone image data during a positive polarity of the voltage signal, the second compensation data being performed during a positive polarity of the voltage signal, whereby the halftone image data is compensated.

15. The image data compensation circuit according to claim 14, when the image data in the one polarity is at the white or black reference level, the first compensation data generator using the white reference compensation data or the black reference compensation data in the memory as the first compensation data.

16. The image data compensation circuit according to claim 14, when the image data in the one polarity is at the white or black reference level, the first compensation data generator using the product of the white reference compensation data or the black reference compensation data in the memory and a coefficient in accordance with the difference between the image data at the white or black reference level and the white reference compensation data or the black reference compensation data in the memory as the first compensation data.

17. The image data compensation circuit according to claim 14, the intermediate reference compensation data in the memory being computed based on a deficiency or an excess of luminance level in positive polarity and negative polarity in a region generated by dividing a screen.

18. A liquid crystal display, comprising;

a memory that stores reference compensation data corresponding to specific levels among levels available to image data, indicating the gray levels of pixels aligned in the form of a matrix in the X direction and the Y direction, for each pair of reference coordinates preset in a display region in which the pixels are aligned;

an interpolation processor that interpolates the reference compensation data stored in the memory in the level directions and that generates first compensation data corresponding to the levels available to the image data for the each pair of reference coordinates;

a compensation table that stores the first compensation data in association with the reference coordinates and the levels;

a reading unit that selectively reads, from the first compensation data stored in the compensation table, pieces of data which correspond to pairs of reference coordinates positioned near the coordinates of the pixel corresponding to the image data and which correspond to the level of the image data;

an arithmetic unit that interpolates the read first compensation data in the coordinate directions and that generates second compensation data corresponding to the image data;

an adder that adds the second compensation data to the image data in a case in which a voltage signal is positive, the second compensation data being performed for a case in which the voltage signal is positive with respect to a predetermined potential, whereby the image data is compensated;

a D/A converter that converts the compensated image data into analog data;

a polarity inverter circuit that inverts the polarity of the voltage signal on the basis of the predetermined potential every predetermined period; and a driving circuit that supplies the inverted voltage signal to each of the pixels.

19. An electronic apparatus, comprising:

the liquid crystal display as set forth in claim 18.

20. An image data compensation circuit that converts image data, indicating gray levels of pixels aligned in an X-Y matrix of a display, into analog data and that compensates a voltage signal which is supplied to each of the pixels based on the image signal, a polarity of the voltage signal being inverted based on a predetermined constant potential every predetermined period, comprising:

a memory that stores reference compensation data for each of pairs of reference coordinates numbering fewer that a number of pixels in the matrix of the display, the reference compensation data being stored for each of RGB colors, the reference compensation data for G color being stored in correspondence with more pairs of reference coordinates than reference compensation data for R color or for B color, the reference compensation data for each of the RGB colors including reference compensation data for a number of specific levels that is smaller than a number of levels available for the image data;

an interpolation processor that interpolates the reference compensation data stored in the memory in the level directions to generate first compensation data corresponding to the levels available to the image data for the corresponding pairs of reference coordinates;

a compensation table that stores the first compensation data in association with the corresponding reference coordinates and the levels;

a reading unit that reads selectively, from the first compensation data stored in the compensation table, pieces of data which correspond to pairs of reference coordinates positioned near the coordinates of the pixel corresponding to the image data and which correspond to the level of the image data;

an arithmetic unit that interpolates the read first compensation data in the coordinate directions to generate second compensation data corresponding to the image data; and an adder that adds the second compensation data to the image data in a case in which the voltage signal is positive, the second compensation data being performed for a case in which the voltage signal is positive with respect to the constant potential, whereby the image data is compensated.

21. An image compensation device that converts image data, indicating gray levels of pixels aligned in a matrix in an X-direction and a Y-direction, into analog data and that compensates the image data when a voltage signal is supplied to each of the pixels, a polarity of the voltage signal being inverted based on a predetermined constant potential every predetermined period, the image compensation device comprising:

a reference compensation data storage unit that stores reference compensation data that corresponds to specific levels among levels available to the image data for each pair of reference coordinates preset in a display region in which the pixels are aligned, the number of specific levels being fewer than the number of levels available to the image data;

a first interpolating unit that interpolates the stored reference compensation data in the level direction to generate first compensation data corresponding to the levels available to the image data for each pair of reference coordinates;

a compensation storage unit that stores the first compensation data in association with each pair of reference coordinates and the levels;

a reading unit that selectively reads, from the compensation storage unit, data that corresponds to pairs of reference coordinates positioned near the coordinates of the pixel corresponding to the image data and that corresponds to the level of the image data;

a second interpolating unit that interpolates the first compensation data read by the reading unit, in coordinate direction to generate second compensation data that corresponds to the image data;

a data output unit that outputs data with values different from the second compensation data generated by the second interpolating unit; and an adding unit that:

adds the second compensation data to the image data in one of a first case in which the voltage signal is positive with respect to the constant potential and a second case in which the voltage signal is negative with respect to the constant potential and that adds the data from the data output unit to the image data in the other one of the first case and the second case.

22. An image compensation device that converts image data, indicating gray levels of pixels aligned in a matrix in an X-direction and a Y-direction, into analog data and that compensates the image data when a voltage signal is supplied to each of the pixels, a poiarity of the voltage signal being inverted based on a predetermined constant potential every predetermined period, the image compensation device comprising:

a reference compensation data storage unit that stores reference compensation data that corresponds to specific levels among levels available to the image data for each pair of reference coordinates preset in a display region in which the pixels are aligned, the number of specific levels being fewer than the number of levels available to the image data;

a first interpolating unit that interpolates the stored reference compensation data in the level direction to generate first compensation data corresponding to the levels available to the image data for each pair of reference coordinates;

a compensation storage unit that stores the first compensation data in association with each pair of reference coordinates and the levels;

a reading unit that selectively reads, from the compensation storage unit, data that corresponds to pairs of reference coordinates positioned near the coordinates of the pixel corresponding to the image data and that corresponds to the level of the image data;

a second interpolating unit that interpolates the first compensation data read by the reading unit, in coordinate directions to generate second compensation data that corresponds to the image data; and an adding unit that adds the second compensation data to the image data in only one of:

a first case in which the voltage signal is positive with respect to the constant potential; and a second case in which the voltage signal is negative wit respect to the constant potential.

23. An image compensation device as claimed in claim 22, further comprising a data output unit that outputs data with values different from the second compensation data generated by the second interpolating unit, the adding unit including a switching unit that switches:

from adding the second compensation data to the image data in the one of the first case and the second case to adding the data from the data output unit to the image data in the other one of the first case and the second case.

24. A display device comprising:

a voltage output unit that supplies at least a high voltage level, a low voltage level, a first voltage level, and a second voltage level to the pixels, the first voltage level and the second voltage level being in between the high voltage level and the low voltage level and corresponding to points where one of a transmissive rate and a reflection rate rapidly changes;

a coefficient output unit that stores data corresponding to sub voltage levels between the low voltage level and the first level and in between the high voltage level and the second voltage level and that outputs first coefficient data that corresponds to a one of the sub voltage levels that is near the voltage level of image data supplied to a pixel;

a coefficient interpolating unit that interpolates the first coefficient data from the coefficient output unit to generate second coefficient data corresponding to voltage level of the image data, the coefficient interpolating unit outputting the second coefficient data;

a multiplier that multiplies the second coefficient data from the coefficient interpolating unit to generate compensation data;

a selection unit that outputs:

the second coefficient data from the coefficient interpolating unit in a case that the level of image data is less than the first voltage level or exceeds the second voltage level and compensation data that has not been multiplied in a case that the level of the image data is equal to or greater than the first voltage level and equal to or less than the second voltage level.

25. A display device as claimed in claim 24, wherein the coefficient output unit includes a look up table that stores coefficients corresponding to at least two levels for image data in a region less than the first voltage level or in a region exceeding the second voltage level.

26. An image compensation device that converts image data, indicating gray levels of pixels aligned in a matrix in an X direction and a Y direction, into analog data and that compensates the image data when a voltage signal is supplied to each of the pixels, a polarity of the voltage signal being inverted based on a predetermined constant potential every predetermined period, the image compensation device comprising:

a reference compensation data storage unit that stores reference compensation data that corresponds to specific levels among levels available to the image data for each pair of reference coordinates preset in a display region in which the pixels are aligned, the number of specific levels being fewer than the number of levels available to the image data;

a first interpolating unit that interpolates the stored reference compensation data in the level direction to generate first compensation data corresponding to the levels available to the image data for each pair of reference coordinates;

a compensation storage unit that stores the first compensation data in association with each pair of reference coordinates and the levels;

a reading unit that selectively reads, from the compensation storage unit, data that corresponds to pairs of reference coordinates positioned near the coordinates of the pixel corresponding to the image data and that corresponds to the level of the image data;

a second interpolating unit that interpolates the first compensation data read by the reading unit, in coordinate directions to generate second compensation data that corresponds to the image data;

a selection unit that selects:

the second compensation data when the voltage signal is one of the positive or negative with respect to the constant potential and other data different from the second compensation data when the voltage signal is the other of positive or negative with respect to the constant potential; and an adding unit that adds the data selected by the selection unit to the image data.

* * * * *